US007393115B2

(12) United States Patent
Tokushita et al.

(10) Patent No.: US 7,393,115 B2
(45) Date of Patent: Jul. 1, 2008

(54) STORAGE CASE

(75) Inventors: Takayuki Tokushita, Tokyo (JP); Natsumi Yanagisawa, Tokyo (JP); Yukitomo Yuhara, Chiba (JP)

(73) Assignee: Yoshida Industry Co., Ltd., Tokyo (JP)

( * ) Notice: Subject to any disclaimer, the term of this patent is extended or adjusted under 35 U.S.C. 154(b) by 61 days.

(21) Appl. No.: 11/046,641

(22) Filed: Jan. 28, 2005

(65) Prior Publication Data

US 2005/0231835 A1 Oct. 20, 2005

Related U.S. Application Data

(63) Continuation of application No. PCT/JP03/09680, filed on Jul. 30, 2003.

(30) Foreign Application Priority Data

| | | |
|---|---|---|
| Jul. 30, 2002 | (JP) | 2002-221189 |
| Apr. 21, 2003 | (JP) | 2003-116289 |
| May 14, 2003 | (JP) | 2003-136605 |
| May 14, 2003 | (JP) | 2003-136606 |
| May 14, 2003 | (JP) | 2003-136607 |
| May 14, 2003 | (JP) | 2003-136608 |
| May 14, 2003 | (JP) | 2003-136609 |

(51) Int. Cl.
*F21V 33/00* (2006.01)

(52) U.S. Cl. ..... 362/136; 362/137; 362/140; 362/143; 132/288; 132/291; 132/293

(58) Field of Classification Search ..... 362/136, 362/143, 137, 140, 800, 240, 241, 251, 253, 362/394, 450; 132/286, 288, 291, 293
See application file for complete search history.

(56) References Cited

U.S. PATENT DOCUMENTS

| | | | | | |
|---|---|---|---|---|---|
| 2,200,114 | A | * | 5/1940 | Konikoff | 362/144 |
| 2,267,132 | A | * | 12/1941 | Pavenick | 362/144 |
| 2,487,883 | A | * | 11/1949 | Le Baron | 132/288 |
| 2,515,437 | A | * | 7/1950 | Bisch et al. | 362/577 |
| 2,651,709 | A | | 9/1953 | Ross | |
| 3,377,476 | A | * | 4/1968 | Milam et al. | 362/136 |
| 3,591,792 | A | * | 7/1971 | Soltan | 362/144 |
| 3,598,987 | A | * | 8/1971 | Kipping | 362/137 |

(Continued)

FOREIGN PATENT DOCUMENTS

| | | |
|---|---|---|
| JP | 45-15880 | 7/1970 |

(Continued)

OTHER PUBLICATIONS

International Search Report for PCT/JP03/09680; ISA/JP; Dated: Nov. 17, 2003.

*Primary Examiner*—Jacob Y Choi
(74) *Attorney, Agent, or Firm*—Harness, Dickey & Pierce, PLC

(57) ABSTRACT

By providing a light source device inside an exterior member forming a contour of a storage case, and by forming a light transmitting portion to transmit light of the light source device to the exterior member, various decorations can be obtained using light, and the storage case can be decorated to create an aesthetically pleasing or original and novel effect to give a characteristic and unique atmosphere.

5 Claims, 35 Drawing Sheets

U.S. PATENT DOCUMENTS

| | | | | | |
|---|---|---|---|---|---|
| 3,714,411 | A | * | 1/1973 | Waters et al. | 362/137 |
| 5,575,552 | A | * | 11/1996 | Faloon et al. | 362/492 |
| 5,930,060 | A | * | 7/1999 | Shih | 359/872 |
| 5,940,120 | A | * | 8/1999 | Frankhouse et al. | 348/61 |
| 5,997,149 | A | * | 12/1999 | Chu | 362/142 |
| 6,848,822 | B2 | * | 2/2005 | Ballen et al. | 362/577 |
| 7,090,378 | B1 | * | 8/2006 | Zadro | 362/298 |
| 7,131,739 | B2 | * | 11/2006 | Sellgren et al. | 359/507 |
| 2001/0032655 | A1 | | 10/2001 | Gindi | |
| 2003/0030063 | A1 | * | 2/2003 | Sosniak et al. | 257/89 |

FOREIGN PATENT DOCUMENTS

| | | | |
|---|---|---|---|
| JP | 48-26149 | | 3/1973 |
| JP | 54-83961 | | 7/1979 |
| JP | 57-074137 | | 5/1982 |
| JP | 58-179012 | | 10/1983 |
| JP | 58-179013 | | 10/1983 |
| JP | 58-179014 | | 10/1983 |
| JP | 59-1310 | | 1/1984 |
| JP | 59-45017 | | 3/1984 |
| JP | 01-130957 | | 5/1989 |
| JP | 41-15386 | | 4/1992 |
| JP | 07-088890 | | 4/1995 |
| JP | 09-182621 | | 7/1997 |
| JP | 11-102601 | | 4/1999 |
| JP | 3068318 | U | 5/2000 |
| JP | 2000-164936 | A | 6/2000 |
| JP | 2002-002742 | | 1/2002 |

* cited by examiner

STORAGE CASE

CROSS-REFERENCE TO RELATED APPLICATIONS

This application claims priority on PCT International Patent Application PCT/JP03/09680 designating the United States of America which was filed on Jul. 30, 2003, the contents of which are herein incorporated by reference.

BACKGROUND OF THE INVENTION

1. Field of the Invention

The present invention relates to a storage case which can obtain a variety of decorations using light, to create an aesthetically pleasing or original and novel effect to give a characteristic and unique atmosphere.

2. Description of Related Art

In general, various kinds of containers are decorated by various methods conventionally to improve the design. For example, a surface of the container is decorated by coloring with a coating or the like, surface treating by sputtering or the like, applying letters or patterns as a plane or a three-dimensional appearance using a plate member or a transfer sheet, and superimposing a transparent or semi-transparent layer over an applied pattern or the like, and providing a portion to insert a sheet member such as a photo (for example, refer to Japanese Patent Application Laid-open Publication No. 54-83961, Japanese Utility Model Application Laid-open Publication No. 58-179012, Japanese Utility Model Application Laid-open Publication No. 58-179013, Japanese Utility Model Application Laid-open Publication No. 58-179014, Japanese Utility Model Application Laid-open Publication No. 59-1310, Japanese Utility Model Application Laid-open Publication No. 59-45017, Japanese Patent Examined Publication No. 1-37248, Japanese Patent Application Laid-open Publication No. 7-88890, and the like).

On the other hand, as a container provided with a light source, there is known that disclosed in Japanese Patent Application Laid-open Publication No. 11-102601. An object of the conventional case is to provide a portable case having a light source so that even if a user is in a place with low lighting, for example, outside at night, in a conference using OHP, or inside a car at nighttime, the user can see inside a bag, and see what one is writing on a memo pad, and see the user's face reflected in a mirror when applying make-up. On an inner surface of a top lid portion of a container which comprises a case body and a top lid portion attached by a hinge to the case body to be able to open and close, there is mounted a light source unit comprised of an acrylic and opalescent diffusion panel, a light source formed of a cold cathode fluorescent tube provided at the rear of the diffusion panel, a reflector mirror attached with a reflector sheet formed of an aluminum thin plate provided in the rear of the light source, a circuit board to light up the light source, a power supply, and a switch means, and the light source is lit up. Thus, the inside of the container body can be lit up, and a face of a person holding the container body can be lit up so that a mirror can be used even in a dark place, and even in a place with low lighting, an object can be lit, and the face of the person in the mirror when applying make-up can be seen. Further, the light source was made to light up at a predetermined brightness, or a dimming means to dim the light manually was provided.

However, the "portable case having a light source" focuses only on the point of illumination, so that various effects which can be made by the light source to the container have not been used effectively or sufficiently. Specifically, in the relationship between the light source and the mirror, the light source and the mirror are provided in separate positions, and the light source only lights up the face or the like, and the mirror only shows the face which is lit up, and these functions were just used separately.

Further, conventionally, as a storage case to store a rod-shaped object, there is disclosed in, for example, Japanese Patent Application Laid-open Publication No. 9-182621, a roll-up type rod-shaped object storage case which rolls up a lipstick which is rod-shaped when using it, and rolls down the lipstick into the storage case when storing it. Such a rod-shaped storage case has generally been decorated by various methods conventionally to improve the design. For example, the surface of the storage case is decorated by coloring with coating or the like, surface treating by sputtering or the like, applying letters or patterns in a flat or a three-dimensional appearance using a plate member or a transfer sheet, and superimposing a transparent or semi-transparent layer over an applied pattern or the like.

Further, as disclosed in for example, Japanese Patent Application Laid-open Publication No. 2002-2742, Japanese Utility Model Application Laid-open Publication No. 1-130957, Japanese Utility Model Application Laid-open Publication No. 48-26149, there is conventionally known a storage case with a case body to store liquid, powder, or cream as a content, which comprises with a lid body attached to and detached from separably by screws and by fitting in a diameter to open and close the case body. The case body has been decorated by various methods conventionally to improve the design. For example, a variety of decorations are applied on the surface of the case body, by using as materials for the case body, glass bottles with color, and laminated tubes printed with patterns or the like, and applying methods such as coating, sputtering and the like for surface treatment, and applying letters or patterns or the like in a plain or a three-dimensional appearance using a plate member or a transfer sheet, and further covering with an exterior body which is made separately.

Further, in regards to the lid body, it has similarly been decorated by various methods conventionally to improve the design. For example, the surface of the lid body has been decorated by coloring with coating or the like, surface treating by sputtering or the like, applying letters or patterns in a flat or a three-dimensional appearance using a plate member or a transfer sheet, and superimposing a transparent or semi-transparent layer over an applied pattern or the like (refer to, for example, Japanese Patent Application Laid-open Publication No. 7-88890).

However, decorations that can be obtained by conventional techniques shown in for example, Japanese Patent Application Laid-open Publication No. 7-88890 are already well-known, and from a technical view of applying decorations, there was a limit.

Further, a conventional container shown in Japanese Patent Application Publication No. 11-102601 has a light source but focuses only on the point of illumination, and lights up the light source at a predetermined brightness, and dims the light by manually operating the dimming means, and does not focus on effectively and sufficiently using various aesthetically pleasing effects that can be given to the container by the light source. That is, it can be considered that, the container was configured under the idea that the light source was necessary only to obtain brightness.

However, when the light source is used, a variety of visual effects can be obtained, and the expression given by the effect of the light can vary even with the same product. The inventors of the present application focused on using light of the light source, and by decorating with light, so as to obtain an aesthetically pleasing decoration which has not been seen before on the storage case, thus achieving the present invention.

SUMMARY OF THE INVENTION

The present invention was made in view of the above problems, and an object of the present invention is to provide a storage case which can be decorated diversely using light, and which can be decorated to have an aesthetically pleasing or original and novel effect to give a characteristic and unique atmosphere.

In order to achieve the above object and other objects, the storage case according to one aspect of this invention wherein a light source device is provided inside an exterior member forming a contour of a storage case, and a light transmitting portion to transmit light of the light source device is formed in the external member.

The storage case according to this aspect can be decorated diversely using light, and can obtain decoration with an aesthetically pleasing or original and novel effect to give a characteristic and unique atmosphere.

Further, a storage case according to another aspect of this invention is a storage case having a case body and a lid body as the exterior members to open and close the case body and attached with a mirror plate on a back side of the lid body, comprising an LED group provided on a back side of the mirror plate and positioned in between the back side of the mirror plate and a back side of the lid body to emit light and to irradiate light of the back side of the lid body around a periphery of the mirror plate, an annular cover to transmit light provided at the periphery of the mirror plate to surround it, a power supply to make the LED group emit light, and a controller to control light emission of the LED group.

The storage case of this aspect is a storage case having a case body and a lid body to open and close the case body as the exterior members and attached with a mirror plate on a back side of the lid body, and with a synergistic effect when combining the LED group and the mirror plate there can be obtained a diverse effect by light, and the storage case comprising the LED group can be decorated to be aesthetically pleasing or original and novel to give a characteristic and unique atmosphere.

Further, the storage case according to yet another aspect of this invention is a storage case having a case body and a lid body as the exterior members to open and close the case body, and provided with a light source device in the lid body, wherein the light source device comprises a controller to control an RGB light source and light emission amount of each color of the RGB light source.

The storage case in this aspect is a storage case having a case body and a lid body to open and close the case body as the exterior members, and provided with a light source device in the lid body, and there can be obtained a diverse effect by light of a light source, and the storage case can be decorated to be aesthetically pleasing or original and novel to give a characteristic and unique atmosphere.

Further, the storage case according to another aspect of this invention is a storage case having a case body and a lid body to open and close the case body as the exterior members, and provided with a light source device at the back side of the lid body, wherein the lid body is partially formed with a light transmitting portion to transmit light of the light source device from the back side of the lid body towards the front side of the lid body.

The storage case according to this aspect is a storage case having a case body and a lid body to open and close the case body as the exterior members, and provided with a light source device at the back side of the lid body, and there can be obtained a diverse effect by light, and the storage case can be decorated to be aesthetically pleasing or original and novel to give a characteristic and unique atmosphere.

Further, the storage case according to yet another aspect of this invention is a storage case attached with an inner dish to store contents inside the case body which is the exterior member, wherein a light source device is provided in between the case body and the inner dish, and the case body is formed with a light transmitting portion to transmit light of the light source device.

The storage case of this aspect is a storage case attached with an inner dish to store contents inside the case body which is the exterior member, and there can be obtained diverse decorations using light, and the storage case can be decorated to be aesthetically pleasing or original and novel to give a characteristic and unique atmosphere.

The storage case according to another aspect of this invention is a storage case having a case body and a lid body as the exterior members to open and close the case body, and provided with a light source device in the lid body, wherein the light source device comprises a light source and a controller to control light emission of the light source, and at least one of the case body and the lid body is provided with a control operation portion to control the controller.

The storage case of this aspect is a storage case having a case body and a lid body to open and close the case body as the exterior members, and provided with a light source device in the lid body, and there can be obtained diverse decorations using light, and the storage case can be decorated to have an aesthetically pleasing or original and novel effect to give a characteristic and unique atmosphere.

Further, the storage case according to yet another aspect of this invention is a storage case comprising a hollow cylindrical case body formed with a helical groove in an inner periphery and which is an exterior member forming a contour of the storage case, a light source device provided inside the case body, a hollow cylindrical cover as an exterior member forming a contour of the storage case with a top end portion protruding from a top end portion of the case body and provided relatively rotatably in the case body, with vertical slits formed in the helical groove formed portions, and formed with a light transmitting portion to transmit light of the light source device, a holding member to hold a rod-shaped object provided relatively movably in a vertical direction in the cover, formed with protrusions which pass through the vertical slits to engage the helical groove, and formed with a light transmitting portion to transmit light of the light source device, and a cap which is removably attached to a top end portion of the case body covering the cover.

The storage case of this aspect is a storage case comprising a hollow cylindrical case body formed with a helical groove in its inner periphery, a hollow cylindrical cover with a top end portion protruding from a top end portion of the case body and provided relatively rotatably in the case body, a holding member to hold a rod-shaped object provided relatively movably in a vertical direction in the cover, formed with protrusions to engage the helical groove, and a cap which is removably attached to a top end portion of the case body to cover the cover, and there can be obtained diverse decorations using light, and the storage case can be decorated to be aesthetically pleasing or original and novel to give a characteristic and unique atmosphere.

Further, the storage case according to another aspect of this invention is a storage case comprising a case body to store liquid, powder, and cream as contents, and a lid body attached to or detached separably from the case body and which is separable therefrom to open and close the case body and is an exterior member forming a contour of the storage case, wherein the lid body is provided with a light source device, and the lid body is formed with a light transmitting portion to transmit light of the light source device.

The storage case of this aspect is a storage case comprising a case body to store liquid, powder, and cream as contents, and a lid body attached to or detached separably from the case body to open and close the case body and is an exterior member forming a contour of the storage case, and there can be obtained diverse decorations using light, and the storage case can be decorated with an aesthetically pleasing or original and novel effect to give a characteristic and unique atmosphere.

Further, the storage according to another aspect of this invention is a storage case comprising a case body to store liquid, powder, or cream as contents, wherein the case body is provided with an exterior body as an exterior member to form a contour of the storage case, and the exterior body is provided with a light source device, and is formed with a light transmitting portion to transmit light of the light source device.

The storage case of this aspect is a storage case comprising a case body to store liquid, powder, or cream as contents, and there can be obtained diverse decorations using light, and the storage case can be decorated to have an aesthetically pleasing or original and novel effect to give a characteristic and unique atmosphere.

BRIEF DESCRIPTION OF THE DRAWINGS

The above and other objects, styles, features, and benefits of this invention, will become clear from the annexed drawings and the following detailed description.

To more fully understand the present invention and the advantages thereof, reference should be made to the following description and the attached drawings.

DETAILED DESCRIPTION OF THE INVENTION

At least the following will become clear by reference to the description herein and by reference to the annexed drawings.

Embodiment 1

Figure 1:
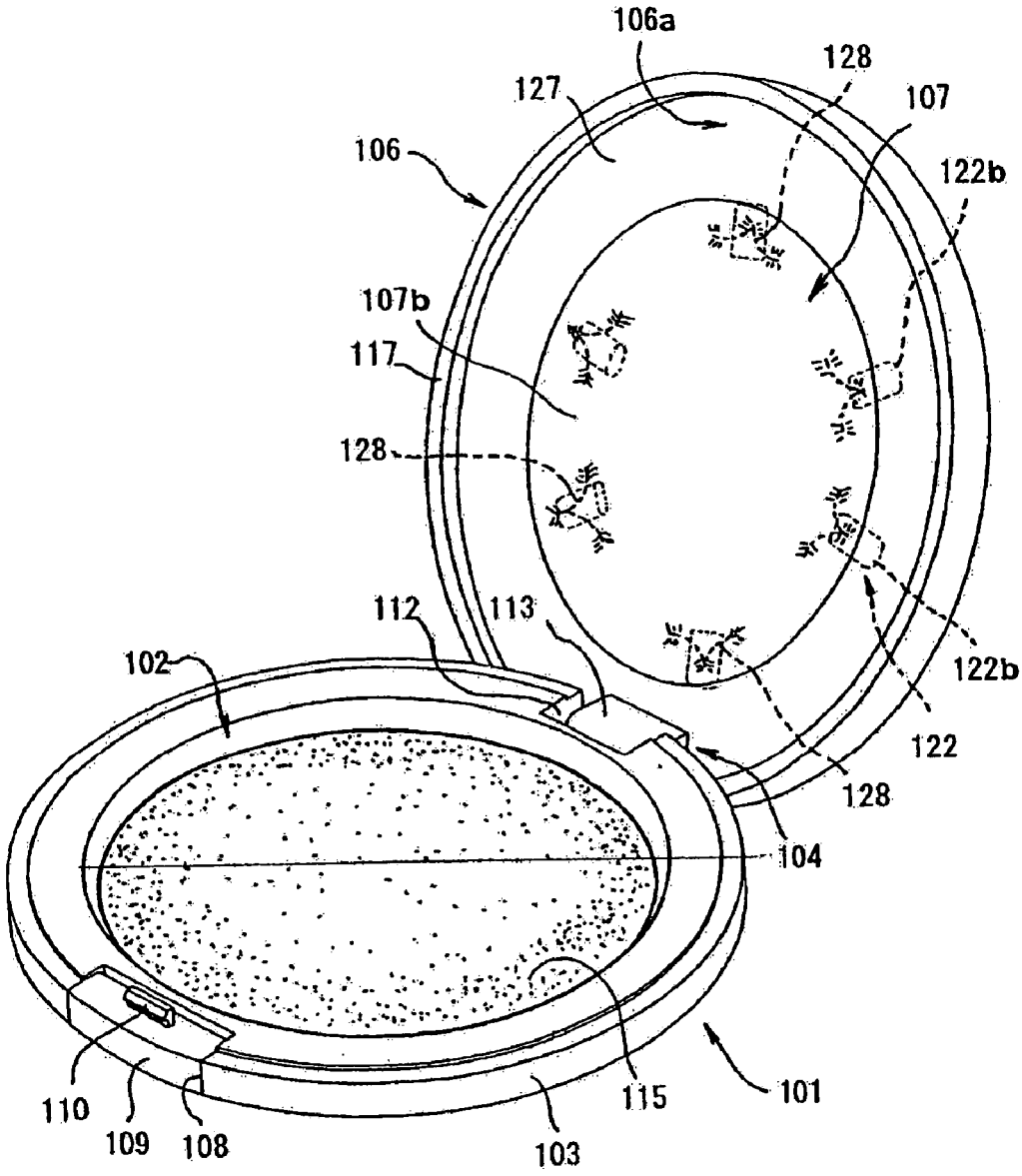
FIG. 1 is a perspective view illustrating a preferred embodiment of a storage case according to the present invention.
Figure 2:
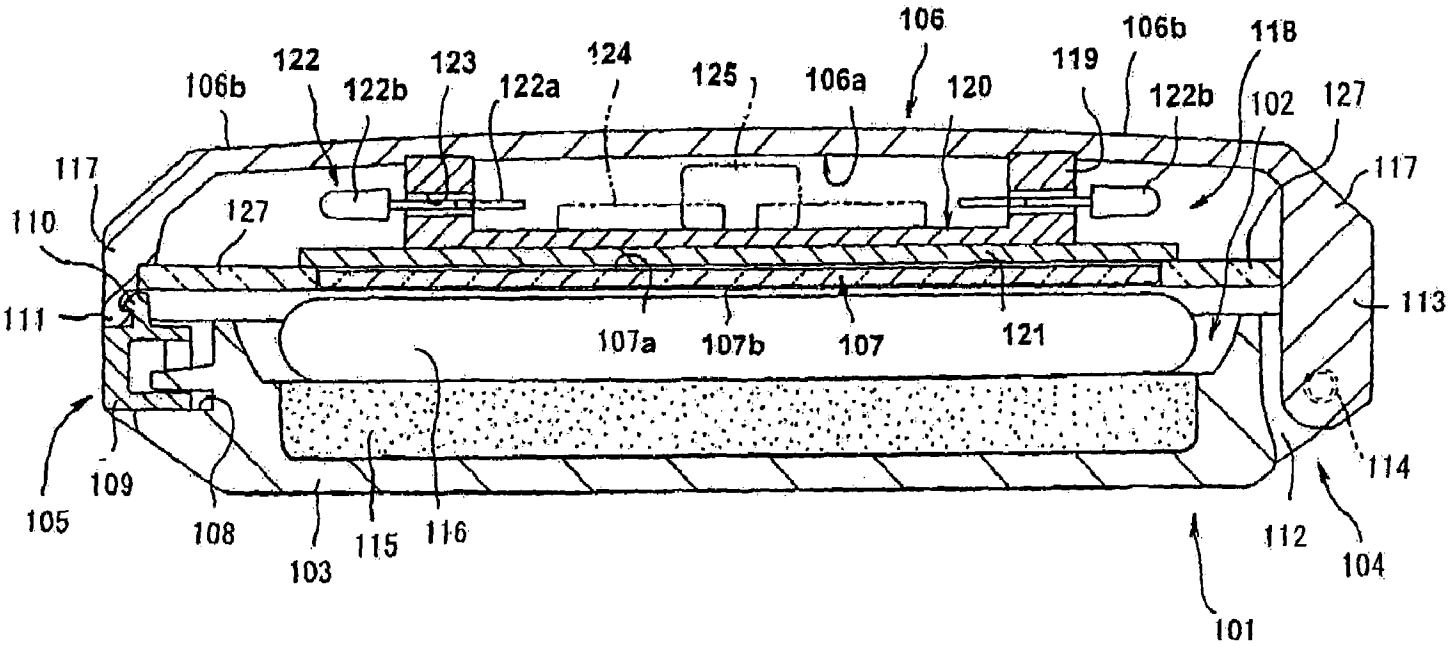
FIG. 2 is a side cross-sectional view of the storage case in FIG. 1.
Figure 3:
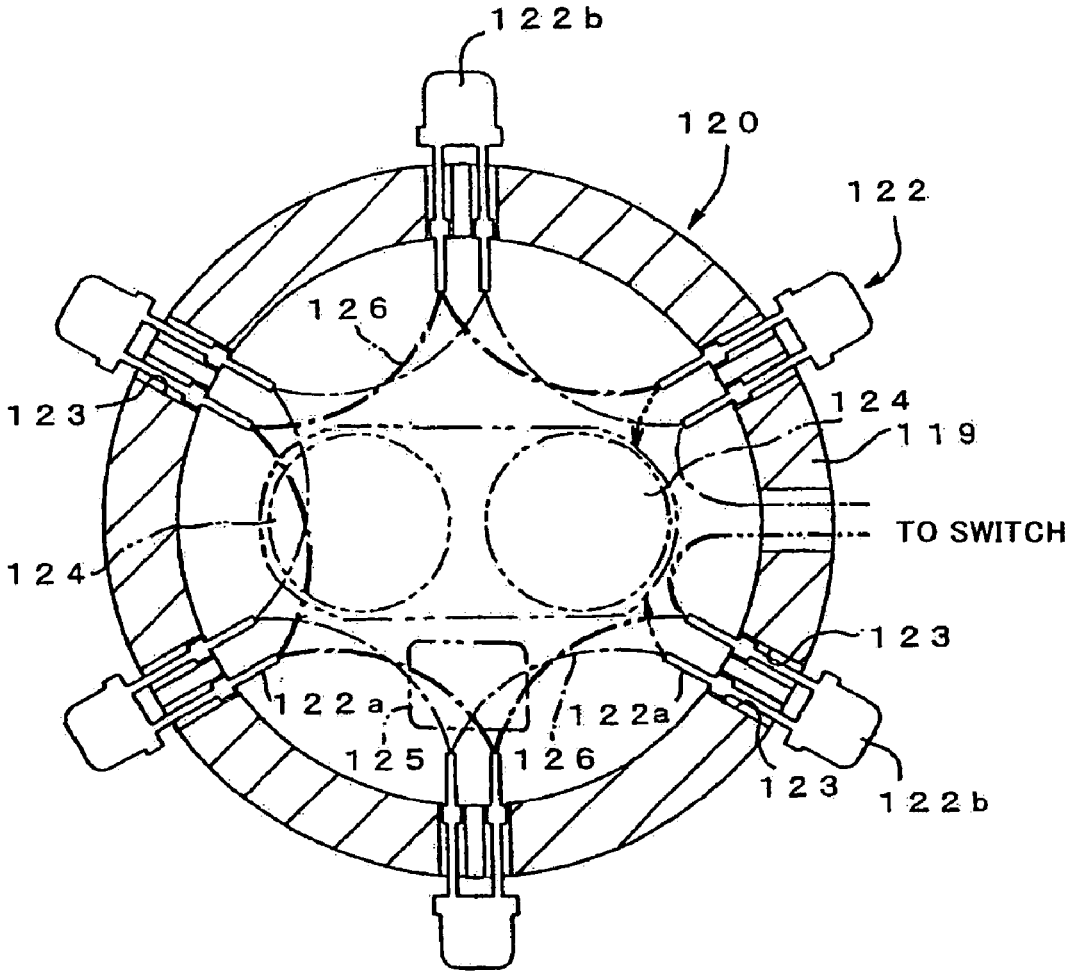
FIG. 3 is a plan view of an attachment board provided in the storage case in FIG. 1.
Figure 4:
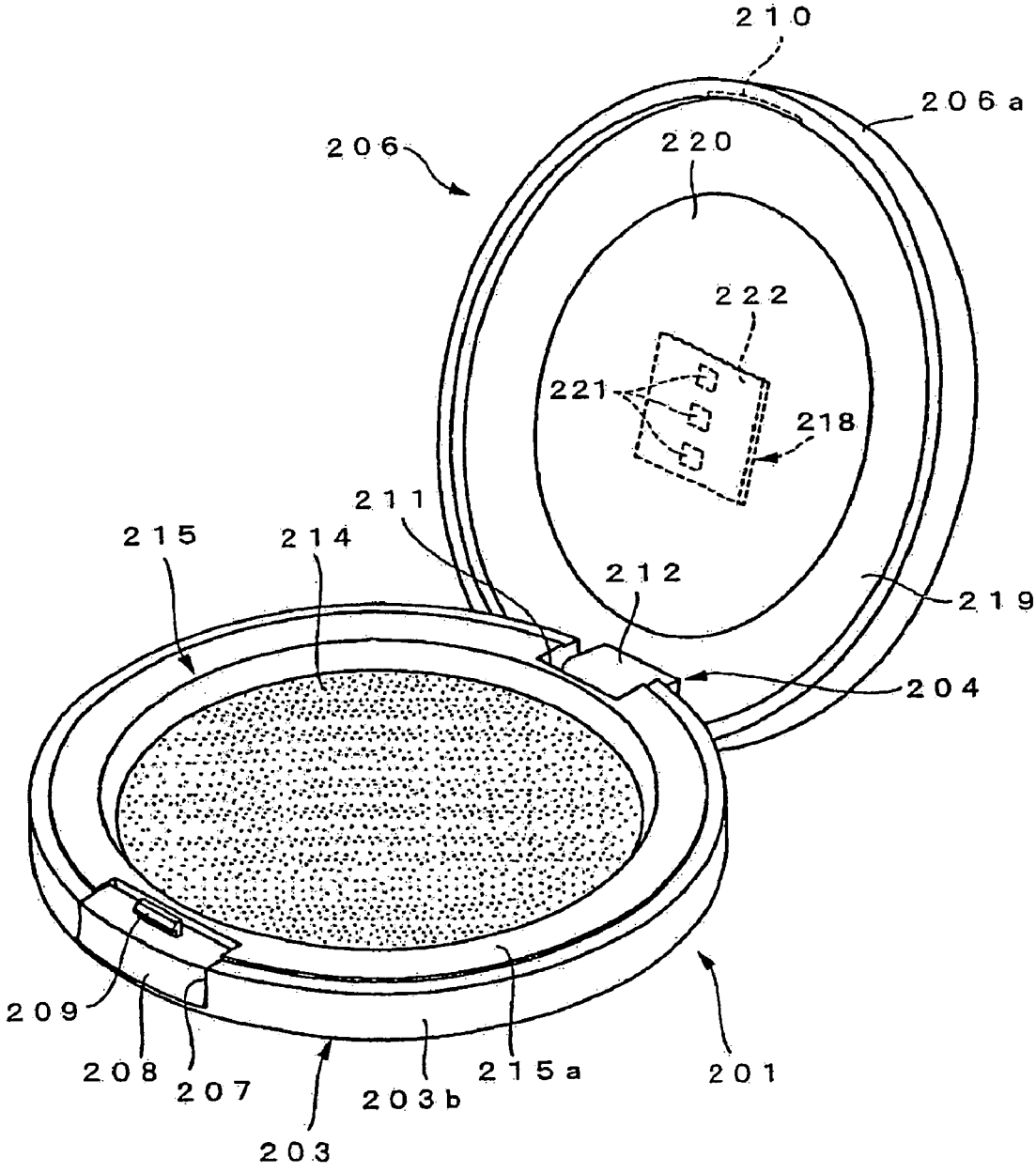
FIG. 4 is a perspective view illustrating a second embodiment of the storage case of the present invention.
Figure 5:
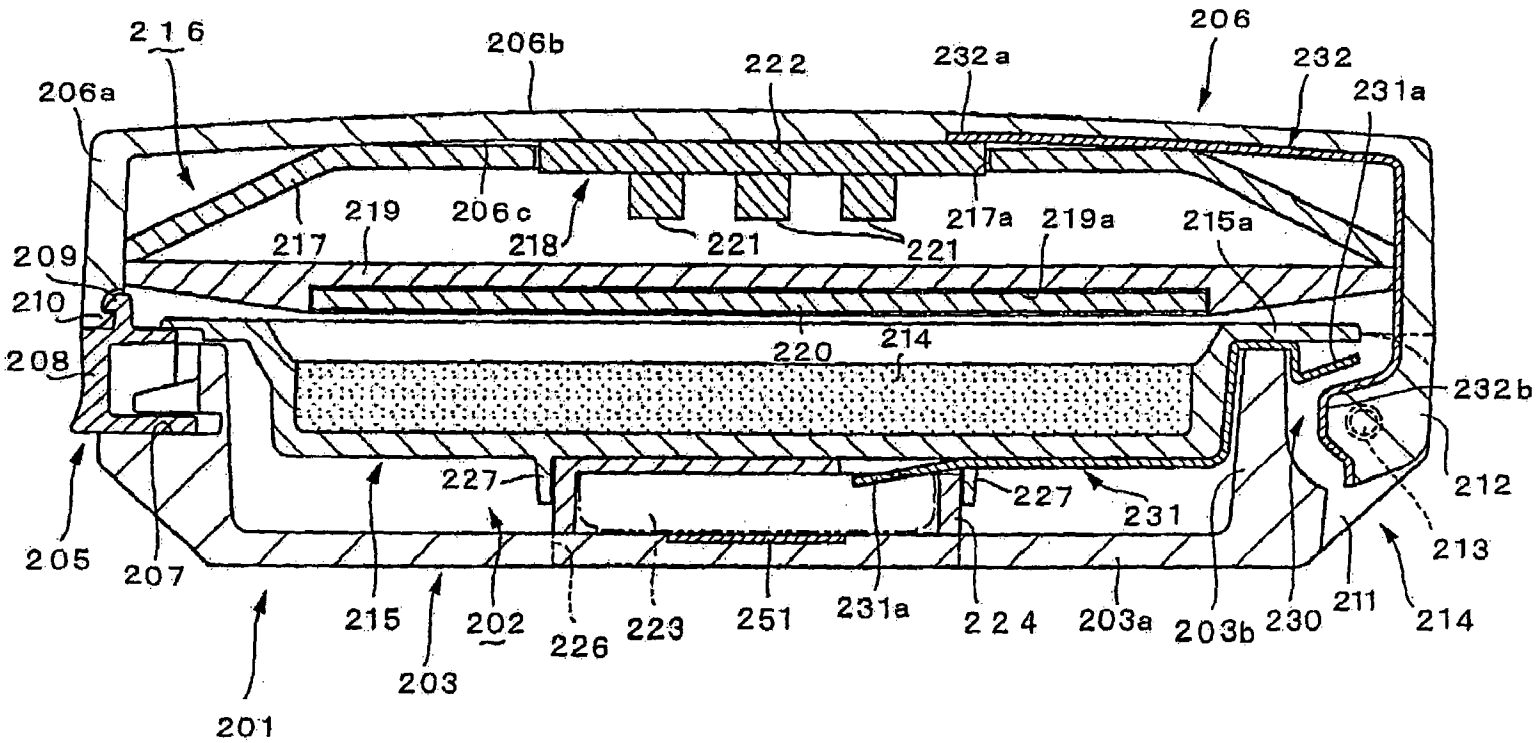
FIG. 5 is a side cross-sectional view of the storage case in FIG. 4.
Figure 6:
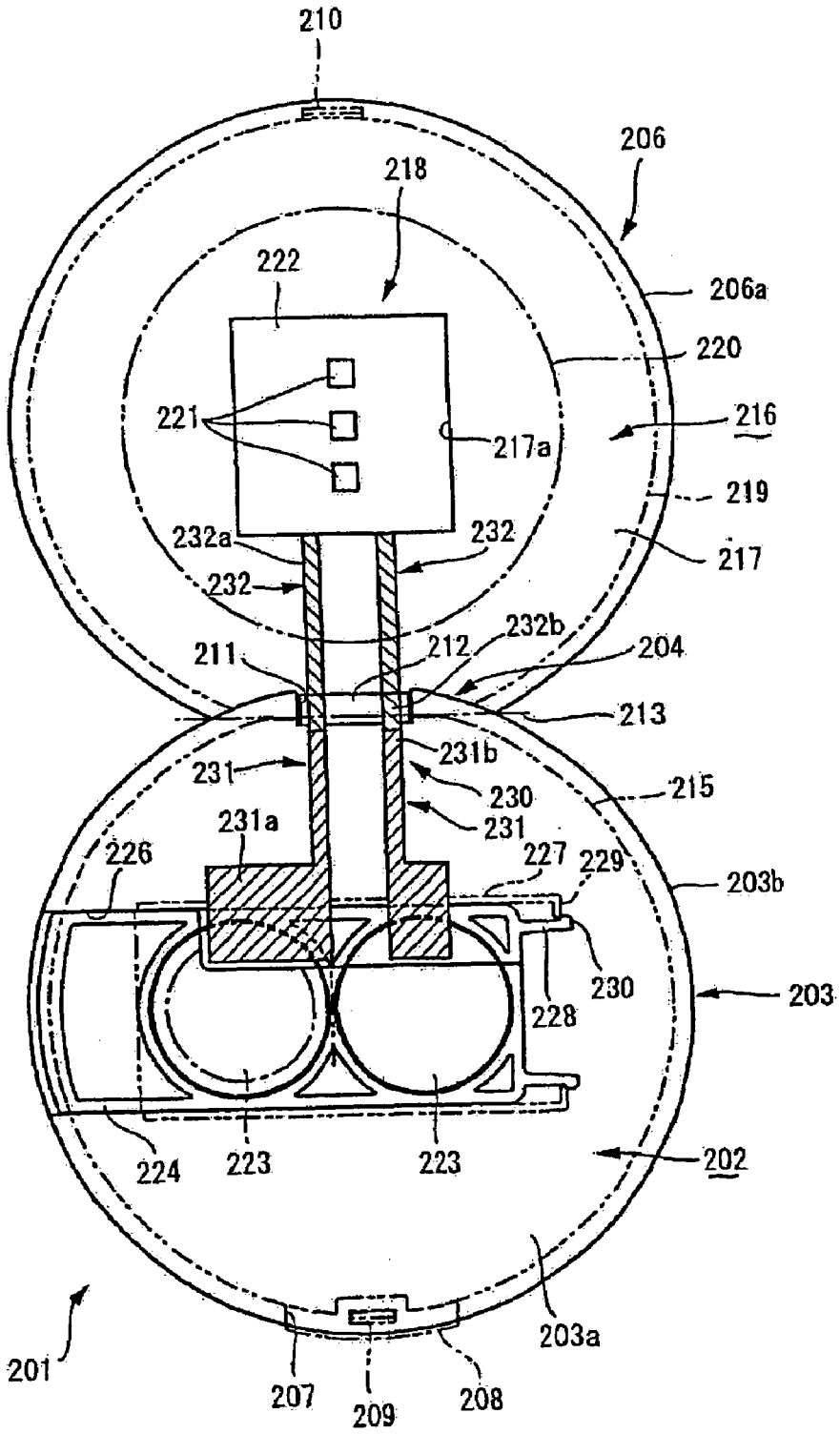
FIG. 6 is a schematic plan view illustrating a state in which the storage case in FIG. 4 is open and an inner plate is removed.
Figure 7:
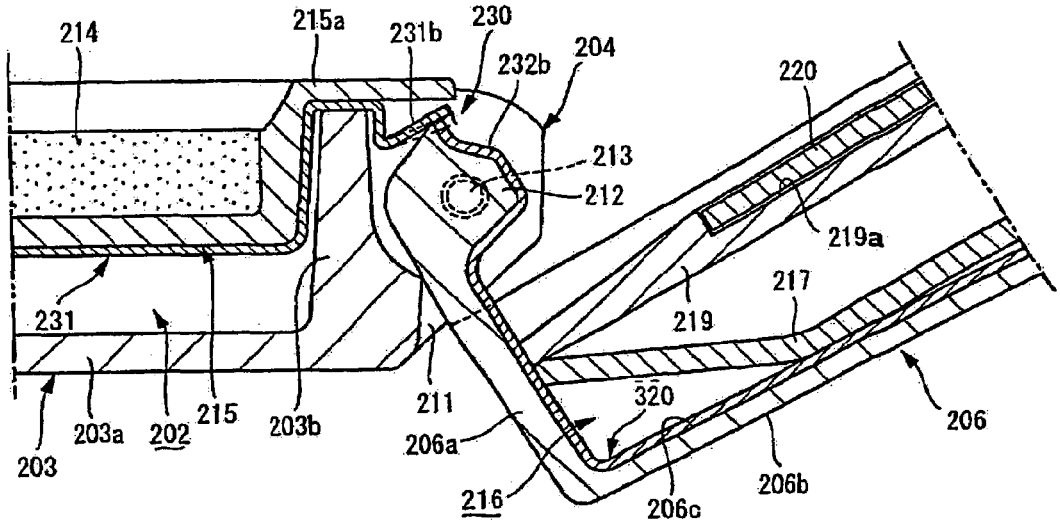
FIG. 7 is a partially enlarged side cross-sectional view illustrating a state in which a lid body of the storage case in FIG. 4 is rotated with contact points in a contacted state.

As illustrated in FIGS. 1 to 3 a storage case 101 according to the present embodiment is mainly constituted by a case body 103 formed with a storing space 102 to store various contents, a lid body 106 which is connected rotatably to one end of the case body 103 by a hinge 104 to close and open the case body 103, and which is engaged engageably and detachably by a hook 105 to another end of the case body 103 to retain the case body 103 in a closed state, and an mirror plate 107 formed with a smaller outer dimension than an outer dimension of the lid body 106 and which is attached to a back surface 106*a* of the lid body 106.

The hook 105 is constructed by a push piece 109 provided slidably in a recess 108 formed in the case body 103, a hooking protrusion 110 formed on the push piece 109, and a hook portion 111 formed on the lid body 106 which engageably engages a hooking protrusion 110. As the push piece 109 is pushed inwardly to the case body 103, the hooking protrusion 110 is separated from the hook portion 111, and the lid body 106 can be opened. Further, the hinge 104 is constructed by a hinge block 113 that droops from the lid body 106 being inserted into a hinge recess 112 formed in the case body 103 at an opposite side to the hook 105, and by a hinge pin 114 being inserted through the case body 103 and the hinge block 113.

In the illustrated example, as the storage case 101, there is illustrated a portable cosmetic case with a puff 116 stored in a storage space 102 placed on top and overlaying cosmetics 115. However, as the storage case 101, it is needless to say that it is not limited to only a cosmetic case, and it can be a case to store any contents, such as jewelry or accessories.

In describing the lid body 106, there is formed an outer wall 117 at an outer edge of the lid body 106 to droop towards the case body 103 side, and in this way the back side 106*a* of the lid body 106 is formed with a compartment of a recess 118 for assembly surrounded by the outer wall 117. This assembly recess 118 is provided with an attachment board 120 formed with a smaller outer dimension than the outer dimension of the mirror plate 107, and formed at the outer edge with an annular protrusion 119 which is to connect the back side 106*a* of the lid body 106, and a transparent plate member 121 superimposed and bonded to the attachment board 120. The back side 107*a* of the mirror plate 107 is bonded to the transparent plate member 121. The attachment board 120 is attached supportedly by the lid body 106 with the annular protrusion 119 with a space between itself and the back side 106*a* of the lid body 106, and the mirror plate 107 is supported by the attachment board 120 by the transparent plate member 121.

Above the attachment board 120 which is to be the back side 107*a* of the mirror plate 107 is provided an LED group 122 positioned in a space in between the attachment board 120 and the back side 106*a* of the lid body 106, that emits light and irradiates light of the back side 106*a* of the lid body 106 around the outer edge of the mirror plate 107. In the illustrated example, the LED group 122 is constructed of six LEDs arranged along a circumferential direction of the mirror plate 107. Connecting terminals 122*a* of the LED group 122 are inserted and supported in through holes 123 formed in the annular protrusion with appropriate intervals in between, and such light emitting portion 122*b* are made to protrude more outer than the attachment board 120 facing the outer edge of the mirror plate 107 or the outer edge of the back side 106*a* of the lid body. Above the attachment board 120 there are mounted button-type batteries 124 as a power supply to make the LED group 122 emit light, and there is also mounted a control element 125 such as an IC chip written with a programming to control light emission of the LED group 122, and by providing a circuit wiring 126 between the above and a switch integrated into the case body 103 or the lid body which is not shown, the LED group 122 is made to emit light according to the programming.

Further, there is provided between the outer edge of the mirror plate 107 and a peripheral wall 117 of the lid body 106 a transparent or semi-transparent annular cover plate 127 to transmit light so as to surround the outer edge of the mirror plate 107. Further, a portion of the lid body 106 at least outer than the attachment board 120 is formed to be transparent or semi-transparent, and the irradiated light of the LED group 122 which transmits through the lid body 106 is made to light up the front side 106*b*. Further, the back side 107*a* of the mirror plate 107 is formed with transmitting portions 128 where silver plating has been partially removed so as to allow the light of the LED group 122 to pass through the mirror plate 107 to be irradiated from the mirror surface 107*b*.

Next, when explaining the operation of the storage case 101 of this embodiment comprising the above constructions, the lid body 106 is rotated to open the case body 103, and when the switch is turned on each LED of the LED group 122 is lit up in various ways such as by blinking or changing the increase or decrease of the illuminance according to a programming written in the control element 125. With such light emission of the LED group 122, the portion from the back side 106*a* of the lid body 106 to the outer edge of the mirror plate 107 is lit up in various ways. The light that lights up the back side 106*a* of the lid body 106 and the outer edge of the mirror plate 107 is transmitted through the annular cover plate 127 as a direct light or a reflected light to light up the periphery of the mirror plate 107 in various ways. Further, the irradiated light of the LED group 122 is transmitted through the transparent or semi-transparent portion of the lid body 106 to light up the surface 106*b*. Further, light of the LED group 122 is transmitted through the mirror plate 107 from the transmitting portions 128 removed of silver plating, and is irradiated outwardly from the mirror surface 107*b*. The switch can be turned on with the storage case 101 in a closed state, and in this case, the irradiated light of the LED group 122 which is transmitted through the transparent or semi-transparent portion of the lid body 106 irradiates the front side 106*b* of the lid body 106.

As described above, the storage case 101 according to this embodiment comprises, the LED group 122 provided on the back side 107*a* of the mirror plate 107 and positioned in between the back side 107*a* of the mirror plate 107 and the back side 106*a* of the lid body 106 that is made to emit light to irradiate light of the back side 106*a* of the lid body 106 around the outer edge of the mirror plate 107, the annular cover plate 127 provided at the outer edge of the mirror plate 107 surrounding it to transmit light, button-type batteries 124 to make the LED group 122 emit light, and a control element 125 to control light emission of the LED group 122. Thus, with the synergistic effect of the combination of the LED group 122 and the mirror plate 107, various effects by light can be obtained, and the storage case 101 comprising the LED group 122 can be decorated to be aesthetic, pleasing or original and novel to give a characteristic and unique atmosphere.

Further, since the lid body 106 is formed to be transparent or semi-transparent to transmit light, the external appearance of the lid body 106 can be decorated to have a characteristic atmosphere using the effect of light. Further, the silver plating of the back side 107*a* of the mirror plate is partially removed, so as to irradiate light of the mirror plate 107*b*, so that the mirror plate 107 itself can be decorated with a characteristic atmosphere using the effect of light. With the above embodiment, the lid body 106 is formed with the transparent or semi-transparent portion, and it is needless to say that it can entirely be formed as non-transparent. Further a case in which the silver plating of the back side 107*a* of the mirror plate is partially removed is described, but the silver plating does not have to be removed necessarily.

Embodiment 2

As illustrated in FIGS. 4 to 7 a storage case 201 according to the present embodiment is mainly constructed of a case body 203 formed with a storage space 202 for storing various contents, and a lid body 206 that is connected rotatably to one end of the case body 203 by a hinge 204, to open and close the case body 203, and engageably engages to another end of the case body 203 by a hook means 205 to retain the case body 203 in a closed state.

The hook means 205 is constructed of a push piece 208 provided slidably in the recess 207 formed in the case body 203, a hooking protrusion 209 formed on the push piece 208, and a hook portion 210 formed on the lid body 206 which engageably engages the hooking protrusion 209. The push piece 208 is depressed inwardly into the hook body 203, so the hooking protrusion 209 detaches from the hook portion 210, and the lid body 206 can be opened. Further, the hinge 204 is constructed by inserting a hinge block 212 that droops from the lid body 206 in a hinge recess 211 formed in the case body 203 at an opposite side to the hook means 205, and inserting a hinge pin 213 through the case body 203 and the hinge block 212.

In the illustrated figure, there is illustrated as a storage case 201, a portable cosmetic case storing in the storage space 202 an inner dish 215 filled with cosmetics 214. However, the storage case 201 is not limited to such a cosmetics case, and it is needless to say that it can be a case to store any contents such as jewelry or accessories.

In describing the lid body 206, there is formed at an outer edge of the lid body 206 an outer wall 206*a* that droops towards the case body 203 side, and as a result forms a compartment of a recess 216 surrounded by the outer wall 206*a* at the back side 206*c* of the lid body 206 which is an opposite side to the front side 206*b* presenting the external appearance. The recess 216 is provided with a reflector plate 217 as a reflector member formed with an opening 217*a* in the center portion, and an outer edge of the opening 217*a* is fixed to the back side 206*c* of the lid body 206, and its outer edge is fixed to an inner surface of the outer wall 206*a*, a light source device 218 inserted in the opening 217*a* of the reflector plate 217 and fixed to the back side 206*c* of the lid body 206 to emit light, and a plate-shaped cover 219 with the outer edge fixed to an inner surface of the outer wall 206*a*, and covering the light source device 218 and the reflector plate 218 with a distance in between to seal the recess 216.

The reflector plate 217 is formed with a side cross section that is curved in a concave parabola shape from the opening 217*a* to the outer edges towards the cover 219 side, and in this way reflects the irradiated light of the light source device 218 towards the cover 219. The cover 219 is formed as transparent or semi-transparent to transmit light. It is preferable that the cover 219 diffuses light. Further, the cover 219 is formed with an indentation 219*a* in a position corresponding to the light source device 218, and this indentation 219*a* is provided with a mirror plate 220 as a covering member to conceal the light source device 219 so it cannot be seen through the cover 219.

The light source 218 is constructed of an RGB light source 221, and an electronic substrate 222 mounted with an electronic component constructing a controller to control the light emission amount of each color of the RGB light source 221, and the RGB light source 221 is directly mounted on the electronic substrate 222. As the RGB light source 221, there can be employed various light sources such as an LED or an electroluminescence (EL) element. As the electronic component constructing the controller, a control element such as an IC chip written with a programming to control light emission of the RGB light source 221 is included, and the RGB light source 221 is made to emit light according to the programming.

As methods of light emission of the RGB light source 221, for example, the entire light emission amount can be increased or decreased to blink slowly, and while it is blinking the light emission rate of red, green and blue can be changed successively to emit light in various colors, or it can be made to blink in short time intervals and at each time to change into various colors to emit light. Any kind of programming can be stored in the control element.

Next, in describing the case body 203, the case body 203 is constructed of a bottom portion 203*a* and a peripheral side wall 203*b* formed rising from an outer edge of the bottom portion 203*a* towards the lid body 206 side, and in this way a storage space 202 to store the inner dish 215 is formed as a compartment inside the case body 203. In this storage space 202, there is provided other than the inner dish 215, a battery case 224 to exchangeably store a button-type battery 223 as a battery to supply electric power to the light source device 218. The inner dish 215 is formed with a depth shallower than that of the storage space 202, and an annular flange portion 15*a* at its outer edge is engaged to a top end of the peripheral side wall 203*b* and fixed to the case body 203, and in this way a space to contain the battery case 224 in between the inner dish 215 and the bottom portion 203*a* of the case body 203.

The battery case 224 is formed as a frame body to hold two button-type batteries 223 in an exposed state with the plus and minus electrodes on both surfaces in opposite directions. The battery case 224 is inserted slidably into a space by a notch portion 226 formed in the case body 203 from the peripheral side wall 203*b* across the bottom portion 203*a*, and a pair of side rails 227 which droop from the inner dish 215 and which are formed towards the back of the storage space 202 from the notch portion 226.

Further, the battery case 224 is formed with engaging protrusions 230 at the tip ends of a pair of resilient elastic pieces 28 protruding forward in the insertion direction, and which engageably and releasably engage with the engaging convex portions 229 formed at the end portions of the pair of slide rails 227 in order to stably hold the battery case inside the storage space 202. Further, the bottom portion 203*a* of the case body 203 is provided with a conductor 225 which makes electrical continuity between one of the electrodes of the two batteries 223, when the battery case 224 is attached in the case body 203. The battery case 224 is inserted into and removed from the space from the notch portion 226 by the side rail 227 to attach to and detach from the case body 203, and thus the batteries 223 can be exchanged.

Further, in order to supply electric power from the batteries 223 in the case body 203 to the light source device 218 in the lid body 206, contact points 230 are provided in the hinge 204 which connect the case body 203 and the lid body 206. The contact points 230 are constructed of a tip end portion 231*b* of lead wires 231 at the battery side with the pair of plus and minus electrodes where the other electrodes of the two batteries 223 are made to be in electrical continuity with the base end portion 231*a*, and a tip end portion 232*b* of the lead wires 232 at the power supply side with a pair of plus and minus electrodes where the base end portion 232*a* is connected to the electronic substrate 222 of the light source device 218. The light source side lead wires 232 are strip shaped, and are provided adhered in series from the recessed portion 216 of the lid body 206 across the hinge piece 212, and the tip end portion 232*b* partially covers a surface of the hinge piece 212.

The lead wires 231 at the battery side are also formed as strip shaped, and besides the base end portion 231 and the tip end portion 231*b*, is adhered in series to the inner dish 215 from the storage space 202 to the hinge recessed portion 211. The base end portion 231*a* of the lead wires 231 at the battery side is formed apart from the inner dish 215 as resiliently deformable, so as to be bend to be able to contact and separate from the batteries 223 to be exchanged. Further, the tip end portion 231*b* of the battery side lead wires 231 protrudes into the hinge recessed portion 211 between the annular flange portion 15*a* of the inner dish 215 and the top end of the peripheral side wall 203*b* of the case body 203, and is formed apart from the annular flange portion 15*a* and the peripheral side wall 203*b* as resiliently deformable.

The light source side lead wires 232 are arranged on the surface, and the hinge piece 212 which rotates in the hinge recessed portion 211 according to the rotation of the lid body 206 is positioned shallow in the hinge recessed portion 211 when the case body 203 is closed by the lid body 206 apart from the tip end portion 231*b* of the battery side lead wires 231 with an appropriate space, and the hinge piece 212 is formed with a contour which resiliently deforms to abut the tip end portion 231*b* of the battery side lead wires 231 in the rotating step of the lid body 206 to open the case body 203 to move deeper into the hinge recessed portion 211. With the rotation of the hinge piece 212, the tip end portions 231*b* and 32*b* of the battery side lead wires 231 and the light source side lead wires 232 contact each other to be able to contact and separate from each other, and thus contact points 230 are constructed that can be contacted and separated to make electrical continuity between the batteries 223 and the light source device 218 according to the rotation amount of the lid body 206.

Further, as necessary, the lid body 206 is formed as transparent or semi-transparent to transmit light, and a portion of the reflector plate 217 is appropriately cut out to transmit light to the lid body 206. A front side 206*b* of the lid body 206 which transmits the irradiated light of the RGB light source 221 is to be lit up by the light. Further, the back side of the mirror plate 220 can be formed if necessary with a transparent portion partially removed of silver plating, so that the light of the RGB light source 221 is irradiated through the cover 219 and by a mirror surface of the mirror plate 220.

Next, in describing the operation of the storage case 201 of this embodiment comprising the above structures, when the hook means 205 is detached and the lid body 206 is rotated to open the case body 203, the contact points 230 are abutted and electric power is supplied from the button-type batteries 223 to the light source device 218, and the RGB light source 221 emits light by blinking or the like in various colors and brightness according to a programming written in the control element. The light of the RGB light source 221 is reflected by the reflector plate 217 through the cover 219 as a direct light or a reflected light and lights up the back side 206*c* of the open lid body 206 in various styles.

Further, the irradiated light of the RGB light source 221 is transmitted through the transparent or the semi-transparent lid body 206 to light up the front side 206*b*. Further, the light of the RGB light source 221 is transmitted through the mirror plate 220 removed of the silver plating and is irradiated outwardly. On the other hand, when the case body 203 is closed by the lid body 206 the contact points separate, and thus the RGB light source 221 is turned off.

Regarding the storage case 201 according to this embodiment as described above, the light source device 218 provided on the lid body 206 is constructed to comprise an RGB light source 221 and a controller to control the amount of light emission of the respective colors of the RGB light source 221, so that the amount of light emission of the respective colors of the RGB light source 221 can be controlled by the controller to control the color and lightness or the like, and thus various effects by light that appeal to vision can be obtained and the storage case 201 can be decorated as aesthetically pleasing or original and novel to give a characteristic and unique atmosphere. That is, it is possible to obtain various visual effects by the irradiated light of the RGB light source 221 which is controlled by the controller, and expressions made by the light can be changed in various ways even with the same product. With this RGB light source 221, the storage case 201 can be given an aesthetically beautiful pleasing decoration effect that has never been seen before.

Further, in a case the case body 203 is connected with the lid body 206 rotatably by the hinge 204, the case body 203 is provided with batteries 223 to supply electric power to the light source device 218, and the hinge 204 is provided with contact points 230 which can be contacted or detached to make electrical continuity between the batteries 223 and the light source device 218 according to the rotation amount of the lid body 206, so the center of gravity of the storage case 201 can be lowered by the weight of the batteries 223, and its stability can be increased, and when the batteries 223 are provided in the lid body 206 the lid body 206 becomes heavy and closes easily but this can also be prevented. Further, by the rotating operation of the lid body 206 that opens and closes the case body 203, supply and termination of electric power from the batteries 223 to the light source device 218 can be automatically switched, and the RGB light source 221 can be made to be practically turned on and off, and its operability can also be increased.

Further, the lid body 206 was formed as transparent or semi-transparent to transmit light, so that the external appearance of the lid body 206 can be decorated with a characteristic atmosphere using effects of light. Further, the lid body 206 is provided with a reflector plate 217 to reflect light of the RGB light source 221, so that light which exerts a visual decorative effect can be effectively irradiated outwardly from the lid body 206. Further, the lid body 206 is provided with a transparent or a semi-transparent cover 219 covering the light source device 218 which transmits light, so that light passes through the cover 219 to be diverged, and various visual effects by such as light diffusion or diffused reflection can be added.

Further, the cover 219 is provided with a mirror plate 220 concealing the light source device 218, so that the light source device 218 can be prevented from been seen through the cover 219, to increase the beautiful appearance. Further, the silver plating of the mirror plate 220 is partially removed, to irradiate light from the mirror surface, so that the mirror plate 220 itself can be decorated with a characteristic atmosphere using effect of light. In the above embodiment, the lid body 206 is formed with a transparent or a semi-transparent portion, but it is needless to say that it can be entirely formed as nontransparent. Further as described in the case of partially removing the silver plating of the mirror plate 220, the silver plating does not necessarily have to be removed.

Embodiment 3

Figure 8:
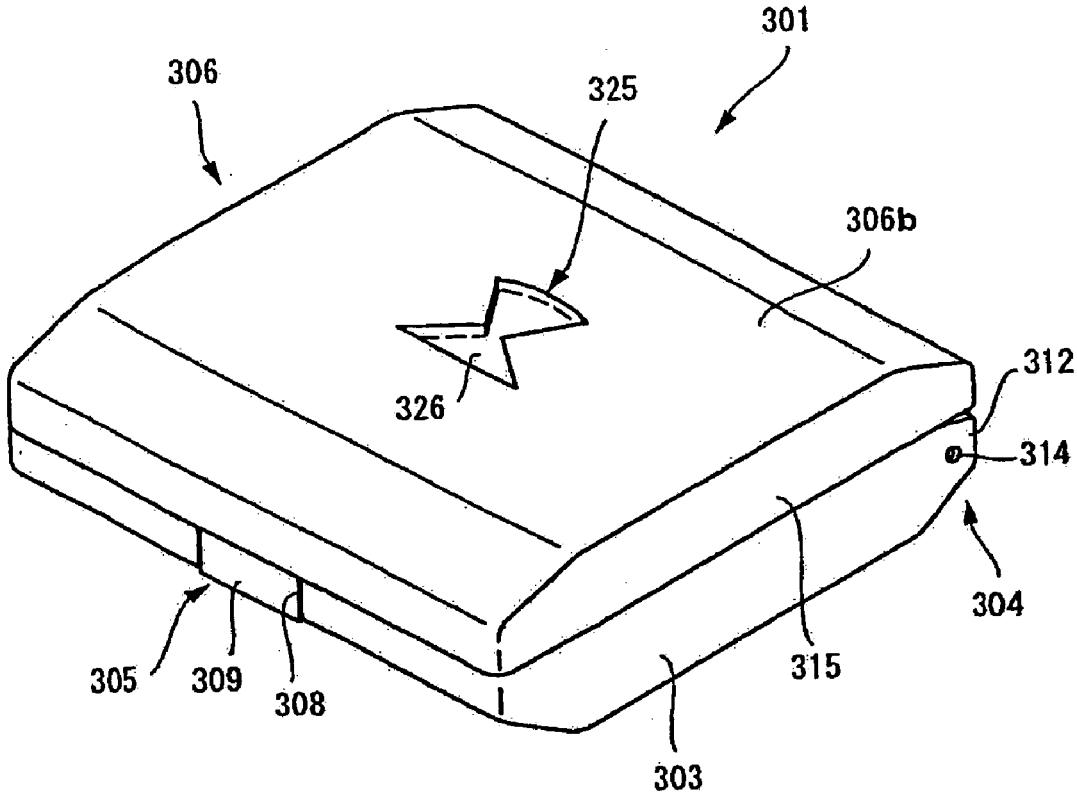
FIG. 8 is a perspective view illustrating a third embodiment of the storage case according to the present invention with the lid body in a closed state.
Figure 9:
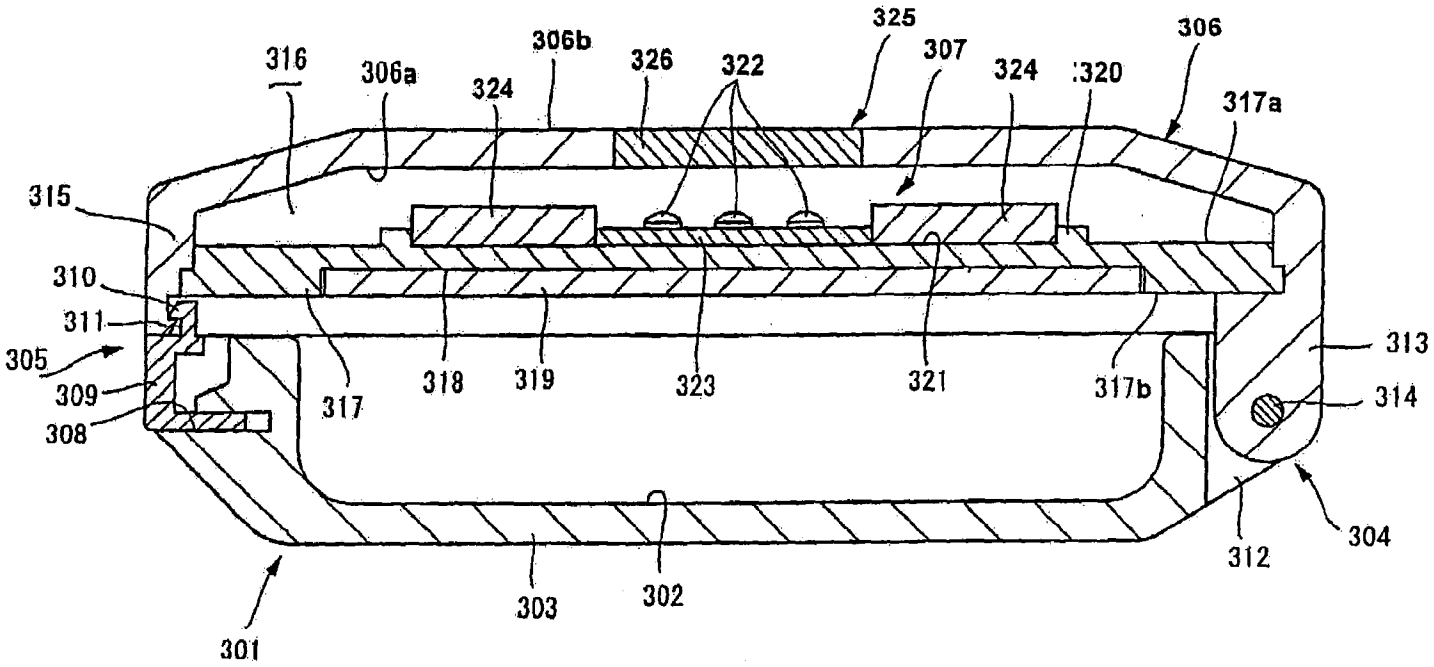
FIG. 9 is a side cross-sectional view of the storage case in FIG. 8.
Figure 10:
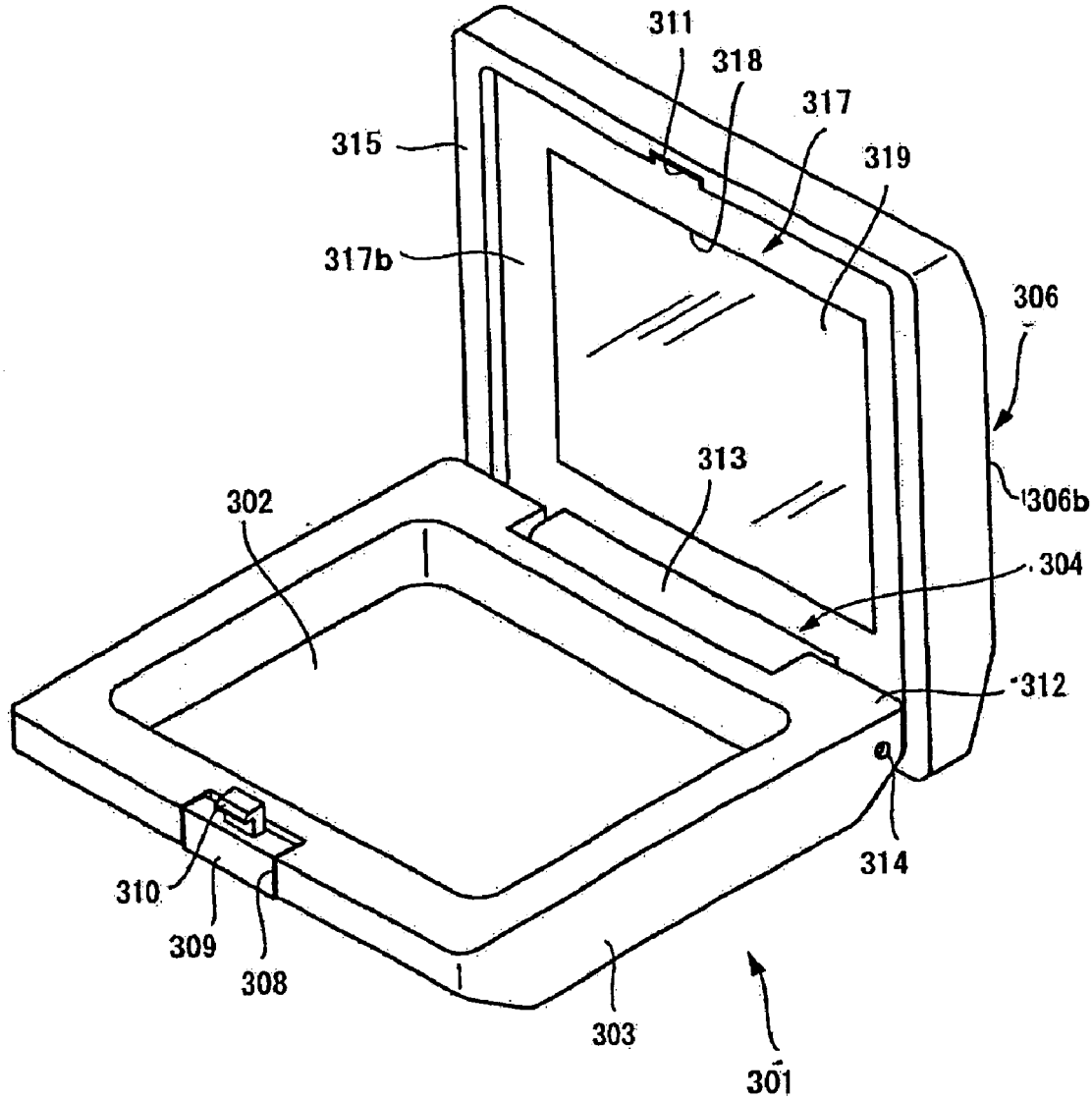
FIG. 10 is a perspective view of the storage case in FIG. 8 with the lid body in an open state.

As illustrated in FIGS. 8 to 10, a storage case 301 according to this embodiment is constructed mainly of a case body 303 formed with a storage space 302 to store various contents, a lid body 306 connected rotatably to one end of the case body 303 by a hinge 304 to open and close the case body 303, and to be engaged engageably and detachably by a hook means 305 to another end of the case body 303 to retain the case body 303 in a closed state, and a light source device provided on a back side of the lid body 306.

The hook means 305 is constructed of a push piece 309 provided in a recess 308 formed in the case body 303 to be able to slide, a hooking protrusion 310 formed on the push piece 309, and a hook portion 311 formed on the lid body 306 and to engage engageably and detachably with the hooking protrusion 310. The push piece 309 is pushed into the case body 303, to detach the hooking protrusion 310 from the hook portion 311, so that the lid body 306 can be opened. Further, the hinge 304 is constructed by a hinge block 313 which droops from the lid body 306 being inserted in a hinge recess 312 formed in the case body 303 at an opposite side to the hook means 305, and by a hinge pin 314 being inserted through the case body 303 and the hinge block 313.

In the illustrated figures, as the storage case 301 there is illustrated a portable cosmetic container to store cosmetics or puff in the storage space 302. However, the storage case 301 is not limited to such a cosmetic container, and it is needless to say that it can be a container to store any contents such as jewelry or accessories.

In describing the lid body 306, the outer edge portion of the lid body 306 is formed with a peripheral wall 315 which droops towards the case body 303 side, and thus a back side 306*a* of the lid body 306 is formed with a compartment of a recessed portion 316 for assembly surrounded by the peripheral wall 315. The recessed portion 316 for assembly is provided attachably and detachably with a cover 317 to cover and seal it by an engaging and detaching mechanism which is not shown. A light source device 307 is attached to a back side 317*a* of the cover 317 opposing the back side 306*a* of the lid body 306.

The cover 317 in this embodiment is formed by a plastic material with color or no color, and which is transparent or non-transparent, so that the light of the light source device 307 can be transmitted therethrough to irradiate externally. The material of the cover 317 can also be glass or the like. The front side 317*b* of the cover 317 is formed with a recess 318 having a smaller outer dimension than an inner dimension of the peripheral wall 315 of the lid body 306, and the recess 318 is attached with a mirror plate 319 apart from the peripheral wall 315. Accordingly, the periphery of the mirror plate 319 is to be lit up by the light of the light source device 307 that is irradiated in the recessed portion 316 for assembly and which is transmitted through the cover 317.

On the other hand, on the back side 317*a* of the cover 317 is formed an annular rib 320 in a position concealed by the mirror plate 319, and the light source device 307 is arranged in an indented portion 321 surrounded by the annular rib 320. The light source device 307 is constructed of an RGB device 322 arranged directed towards the back side 306*a* of the lid body 306, an electronic substrate 323 mounted with an electronic component constructing a controller controlling the light emission amount of each of the colors of the RGB light source 322, and batteries 324 that are button-type batteries supplying electric power to the electronic substrate 323 and through the substrate to the RGB light source 322. The RGB light source 322 is directly mounted on the electronic substrate 323.

As the RGB light source 322, there can be applied various light sources that are conventionally known, for example, an LED or an organic electroluminescent (EL) element. As the electronic components constructing the controller, there is included a control element such as an IC chip written in with a programming to control light emission of the RGB light source 322, and as electric power is supplied from the batteries 324 by a switch that is not shown, the RGB light source 322 is made to emit light according to the programming.

To cause the RGB light source 322 to emit light, for example, the entire light emission amount can be increased and decreased, to make the RGB light source blink slowly, and while it is blinking, the light emission rate in red, green, and blue can be subsequently changed to make it emit light in various colors, or the RGB light source can be made to blink in short time intervals to change color each time to emit light, and any kind of programming can be stored in the control element. The light source is not limited to the RGB light source 322, and it is needless to say that it can be a monochromatic light source.

In the present embodiment, the lid body 306 is almost entirely formed of a light proof plastic material on the one hand, and on the other hand a light transmitting portion 325 that transmits light of the RGB light source 322 from the back side 306*a* towards the front side 306*b* of the lid body 306 is partially formed. The light transmitting portion in this embodiment is formed of a translucent member 326 such as a plastic material, glass, or crystal which has no color or has color, and is transparent or non-transparent.

The translucent member 326 is provided in the lid body 306 by a method, for example, such as insertion molding where it is attached inside a mold beforehand when injection molding the plastic lid body 306 to integrate it with the resin to be ejected. In particular, the translucent member 326 can be formed in various styles with letters and marks and also according to a desired design, and by attaching this to the lid body 306 by ejection molding and the like, the light translucent portion 325 with an arbitrary shape is formed in the lid body 306.

Next, the operation of the storage case 301 of this embodiment comprising the above structures is described. When a switch which is not shown is turned on, electric power is supplied from the batteries 324 to the RGB light source 322 or the electronic substrate 323, and the RGB light source 322 emits light in various colors and brightness while blinking or the like, according to a programming written in the control element. The light of the RGB light source 322 is irradiated outwardly through the light transmitting portion 325 of the lid body 306*b*, and lights up letters, marks and designs represented by the light transmitting portion 325 of the lid body front side 306*b* in various styles. Further, even in a case that the lid body 306 is open, the periphery of the mirror plate 319 is lit up in various styles by the light of the RGB light source 322 which is transmitted through the cover 317. When the switch is turned off, the RGB light source 322 is turned off.

The storage case 301 of this embodiment as described above transmits light of the RGB light source 322 by the light transmitting portion 325 partially formed in the lid body 306, to irradiate from the back side 306*a* of the lid body 306 to the front side 306*b*, so that the front side 306*b* of the lid body 306 can be decorated in various ways using light, and the storage case 301 can be decorated with an aesthetically pleasing, or original and novel effect to give a characteristic and unique atmosphere.

Further, the back side 306*a* of the lid body 306 is provided with the mirror plate 319, and the cover 317 which transmits light of the RGB light source 322 at the periphery of the mirror plate 319, so that as illustrated in FIG. 10, when the case body 303 is open to expose the back side 306*a* of the lid body 306, the periphery of the mirror plate 319 is lit up by the light of the light source device 307 transmitted through the cover 317, and with the synergic effect of the combination of the light and the mirror plate 319, there can obtained the effect using light on the storage case 301.

Further, the light source device 307 is constructed of the RGB light source 322, the electronic substrate 323 mounted with a controller to control light emission of the RGB light source 322, and batteries 324 to supply electric power to the electronic substrate 323 and the RGB light source 322, and the controller is made to control light emission of the RGB light source 322, so that various effects by light that appeal to vision can be obtained, and the storage case 301 can be decorated as aesthetically pleasing, or original and novel to give a characteristic and unique atmosphere.

Figure 11:
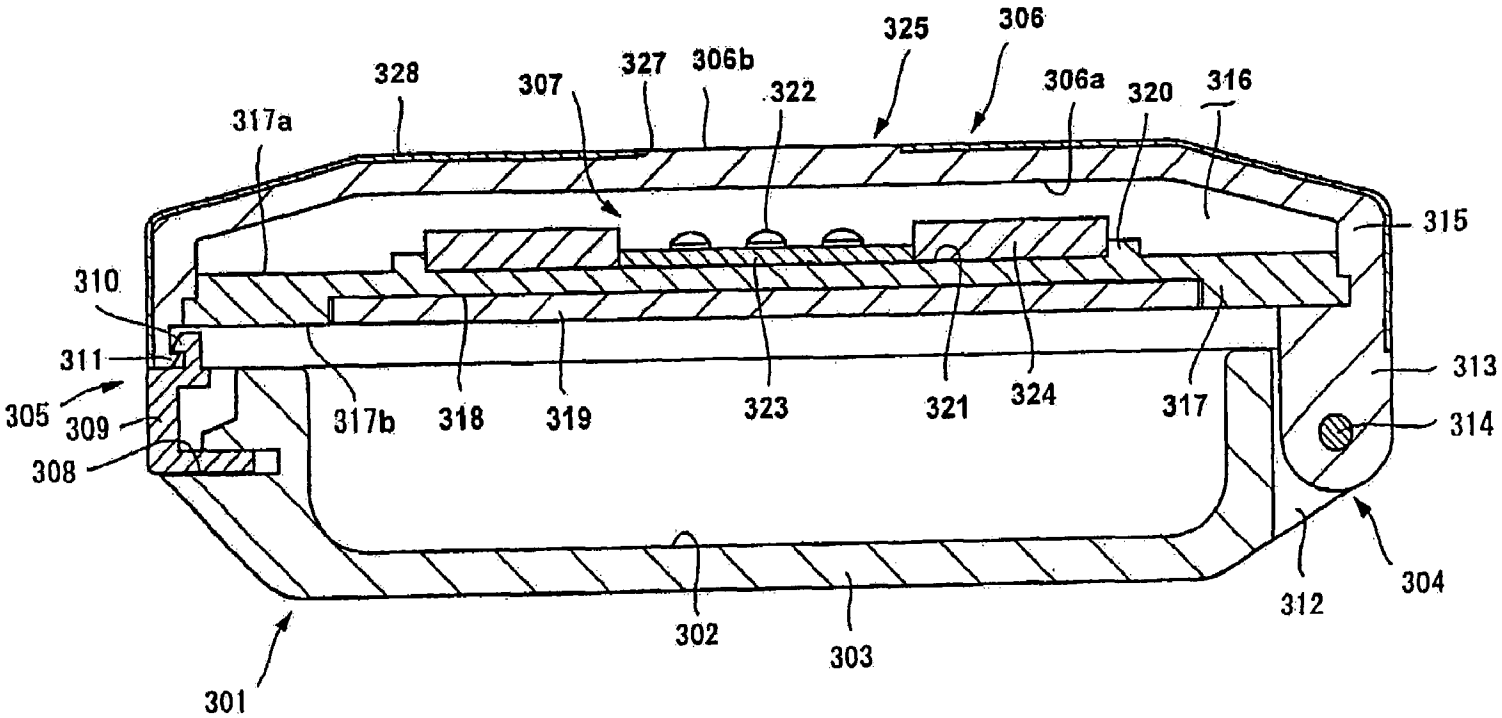
FIG. 11 is a side cross-sectional view illustrating a modified example of the storage case in a third embodiment according to the present invention.
Figure 12:
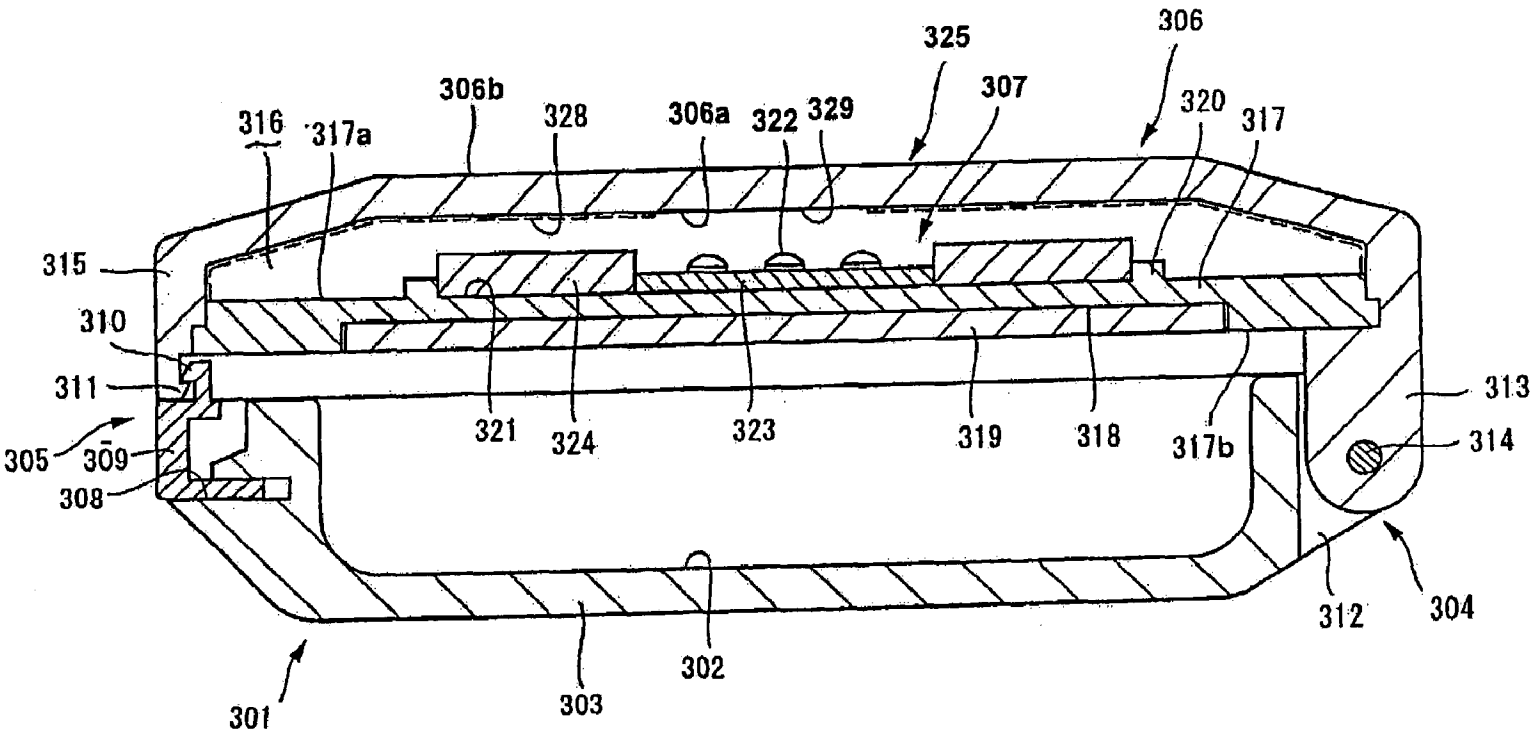
FIG. 12 is a side cross-sectional view illustrating another modified example of the storage case in the third embodiment according to the present invention.

FIGS. 11 and 12 illustrate a modified example of the lid body 306 formed with a light transmitting portion 325. In both FIGS. 11 and 12, the lid body 306 is formed of a plastic material with no color or with color, and which is transparent or semi-transparent to be translucent. In FIG. 11, a lightproof mask 328 such as a nontransparent sheet member or a resin molded component partially formed with a stamped out portion 327 is integrally provided on the front side 306*b* of the lid body 306 by insert molding, and the stamped out portion 327 of the lightproof mask 328 is to form the light transmitting portion 325 in the lid body 306. In FIG. 12, the back side 306*a* of the lid body 306 is formed with a lightproof mask 328 by coating nontransparent coating on the one hand, and on the other hand a portion 329 which is not coated is assigned and the portion 329 not coated is used to form the light transmitting portion 325 in the lid body 306.

In the modified examples, it is needless to say that similar effects as the above embodiments can be obtained. In particular, in the modified examples, when the light transmitting portion 325 is formed in the lid body 306, the entire lid body 306 is formed as translucent with transparency, and a lightproof mask 328 such as a sheet member is prepared, and by simply attaching this to the lid body 306 the light transmitting portion 325 can be formed, and various decorations using light can be easily achieved to easily achieve an aesthetically pleasing, or original and novel decoration effect to give a characteristic and unique atmosphere.

Note that, the formation of the lightproof mask 328 to the lid body 306 can be performed by methods such as attaching a metal plate stamped according to a design, and sputtering.

Embodiment 4

Figure 13:
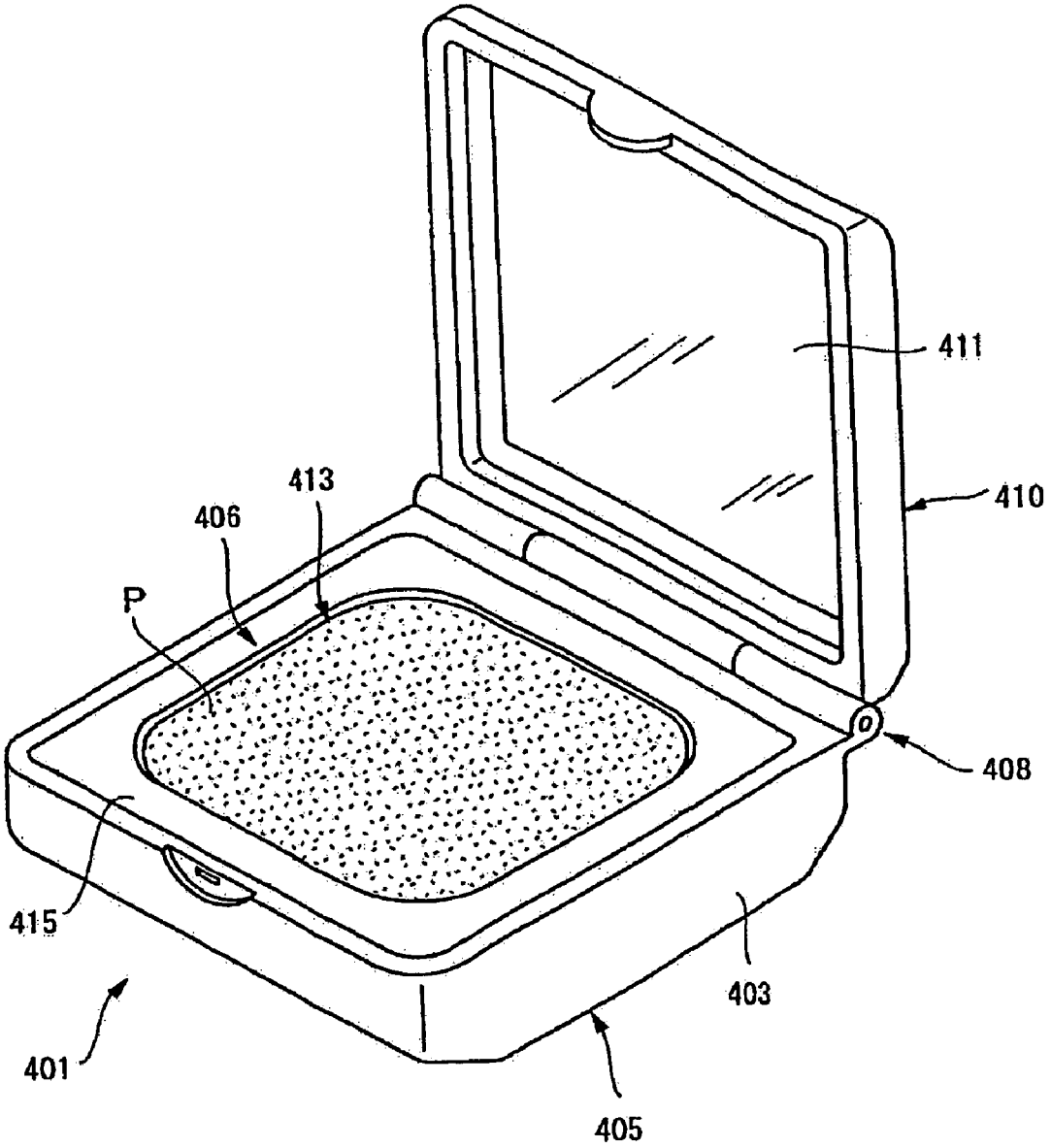
FIG. 13 is a perspective view illustrating a fourth embodiment of the storage case according to the present invention.
Figure 14:
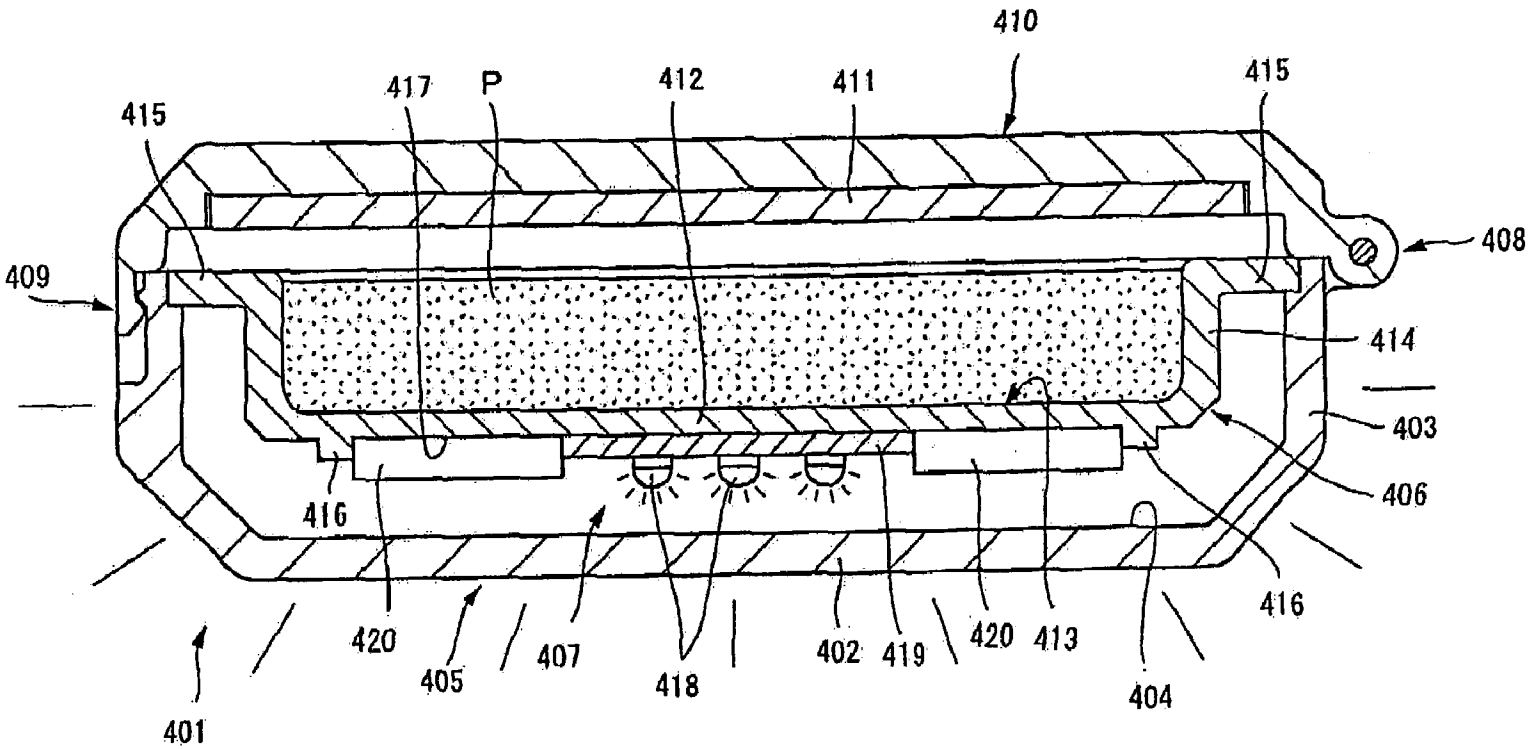
FIG. 14 is a side cross-sectional view of the storage case illustrated in FIG. 13.

A storage case 401 according to Embodiment 4 as illustrated in FIGS. 13 and 14 is constructed mainly of a dish-shaped case body 405 formed with a compartment of a recess 404 having a bottom wall 402 and a peripheral wall 403 formed rising upwardly from an outer edge of the bottom wall 402, an inner dish 406 attached to the case body 405 to store various contents, a light source device 407 provided between the inner dish 406 and the case body 405, a lid body 410 connected rotatably by a hinge 408 to one end of the case body 405 to close and open the case body 405, and engaged engageably and detachably to another end of the case body 405 by a hook means 409 to retain the case body 405 in a closed state, and a mirror plate 411 provided on a back side of the lid body 410.

In the illustrated example, as the storage case 401, there is illustrated a portable cosmetic container storing cosmetics P in the inner dish 406. However, the storage case 401 is not limited to such cosmetic container, and it is needless to say that it can be a container to store any contents such as jewelry, or accessory in the inner dish 406.

In describing the inner dish 406, the inner dish 406 is constructed of a bottom plate portion 412 formed with a smaller plane outer dimension than a plane inner dimension of the recess 404 of the case body 405, an annular wall portion 414 rising upwardly from the outer edge of the bottom plate portion 412 and formed with a height that is less than the depth of the recess 404, and forming a compartment of a storage space 413 for the cosmetics P above the bottom plate portion 412, and an annular flange portion 415 formed to protrude outwardly from the upper end outer edge of the annular wall portion 414 and which engages engageably and detachably the upper end of the peripheral wall 403 of the case body 405. Thus, the inner dish 406 is attached inside the recess 404 of the case body 405, in a state apart from the bottom wall 402 of the case body 405 and with a distance vertically from the bottom plate 402.

In this embodiment, the light source device 407 is provided in the space between the inner dish 406 and the case body 405 and integrated in a grooved portion 417 surrounded by an annular rib 416 protruding downwardly from the bottom plate portion 412 of the inner dish 406. The light source device 407 is constructed of RGB light source 418 arranged towards the bottom wall 402 of the case body 405, an electronic substrate 419 mounted with an electronic component constructing a controller controlling the light emission amount of each color of the RGB light source 418, and batteries 430 such as button-type batteries to supply electric power to the electronic substrate 419 and through this to the RGB light source 418. The RGB light source 418 is directly mounted on the electronic substrate 419.

As the RGB light source 418, there can be implemented various light sources that are conventionally known, for example, an LED or an organic electroluminescent (EL) element. As the electronic component constructing the controller, there is included a control element such as an IC chip written in with a programming to control light emission of the RGB light source 418, and as electric power is supplied from the batteries 420 by a switch which is not shown, the RGB light source 418 is made to emit light according to a programming.

To cause the RGB light source 418 to emit light, for example, the entire light emission amount can be increased and decreased, to make the RGB light source blink slowly, and while it is blinking; the light emission rate in red, green, and blue can be subsequently changed to make it emit light in various colors, or the RGB light source can be made to blink in short time intervals to change color each time to emit light, and any kind of programming can be stored in the control element. The light source is not limited to the RGB light source 418, and it is needless to say that it can be a monochromatic light source.

In particular, the case body 405 is formed with a light transmitting portion to transmit light of the RGB light source 418. In this embodiment, the case body 405 is formed entirely of translucent material such as plastic, glass, or crystal which has color or has no color, and is transparent or semi-transparent, and the entire case body 405 is formed as the light transmitting portion. The case body 405 causes the light the RGB light source 418 to irradiate outwardly from inside of the recess 404, to be lit up entirely by the light. Further, the inner dish 406 in this embodiment is formed entirely from a translucent material as a light transmitting portion similar to the case body 405, and the light of the RGB light source 418 is irradiated outwardly from the annular flange portion 415, so as to light up the periphery of the storage space 413.

Next, the operation of the storage case 401 of this embodiment comprising the above structures is described. When the switch which is not shown is turned on, electric power is supplied from the batteries 420 to the RGB light source 418 or the electronic substrate 419, and the RGB light source 418 emits light in various colors and brightness while blinking or the like, according to a programming written in the control element. The light of the RGB light source 418 is irradiated externally from the entire case body 405 which is a light transmitting portion, and lights the entire front side of the case body 405 in various styles. Further, when the lid body 410 is open, the light of the RGB light source 418 which is transmitted by the annular flange portion 415 causes the periphery of a storage space 413 of the inner dish 406 to be lit up in various styles. When the switch is turned off, the RGB light source 418 is turned off.

In respect to the storage case 401 according to this embodiment as described above, light of the light source device 407 provided in between the case body 405 and the inner dish 406 is transmitted outwardly from inside the case body 405 formed entirely of a translucent material, so that the front side of the case body 405 is to be lit up entirely. In this way, the front side of the case body 405 can be decorated in various ways using light, and the storage case 401 can be decorated with an aesthetically pleasing, or original and novel effect to give a characteristic and unique atmosphere.

Further, the inner dish 406 is formed entirely of translucent material, so as to form the light transmitting portion, and light of the light source device 407 is transmitted outwardly from the annular flange portion 415 of the inner dish 406, and the periphery of the storage space 413 is to be lit up. In this way, not only the case body 405 but also the inner dish 406 can be decorated in various ways using light, and the storage case 401 can obtain an effect using light.

Further, the light source device 407 is constructed of the RGB light source 418, the electronic substrate 419 mounted with the controller to control light emission of the RGB light source 418, and batteries 420 to supply electric power to the electronic substrate 419 and the RGB light source 418, and the controller is made to control light emission of the RGB light source 418, so that various effects by light which appeals to vision can be realized, and the storage case 401 can be decorated to be aesthetically pleasing, or original and novel to give a characteristic and unique atmosphere.

In the above embodiment, the inner dish 406 is to be formed entirely of a translucent material to form the light transmitting portion, and it is needless to say that instead it can be formed entirely of a translucent material.

Embodiment 5

Figure 15:
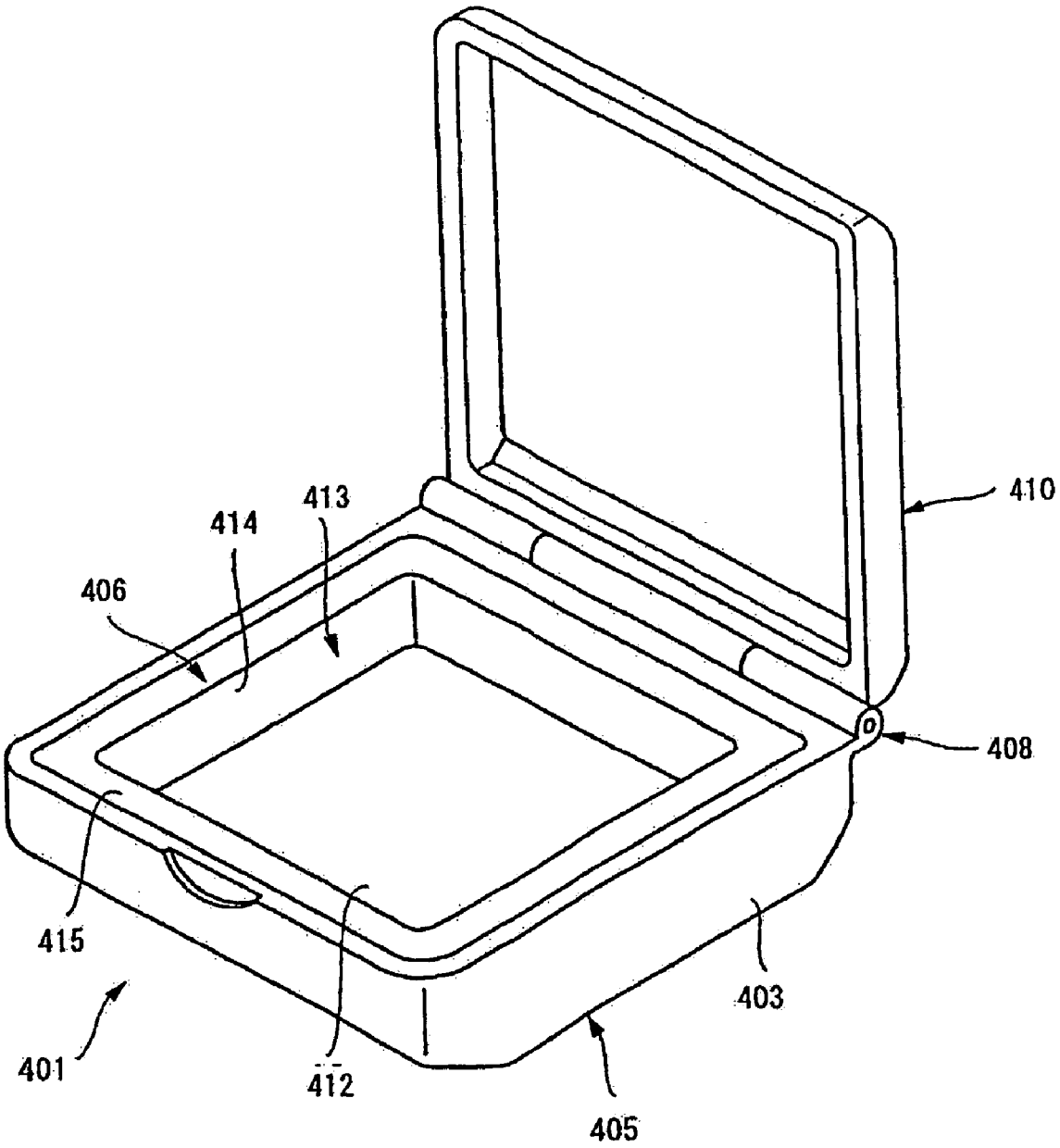
FIG. 15 is a perspective view illustrating a fifth embodiment of the storage case according to the present invention.
Figure 16:
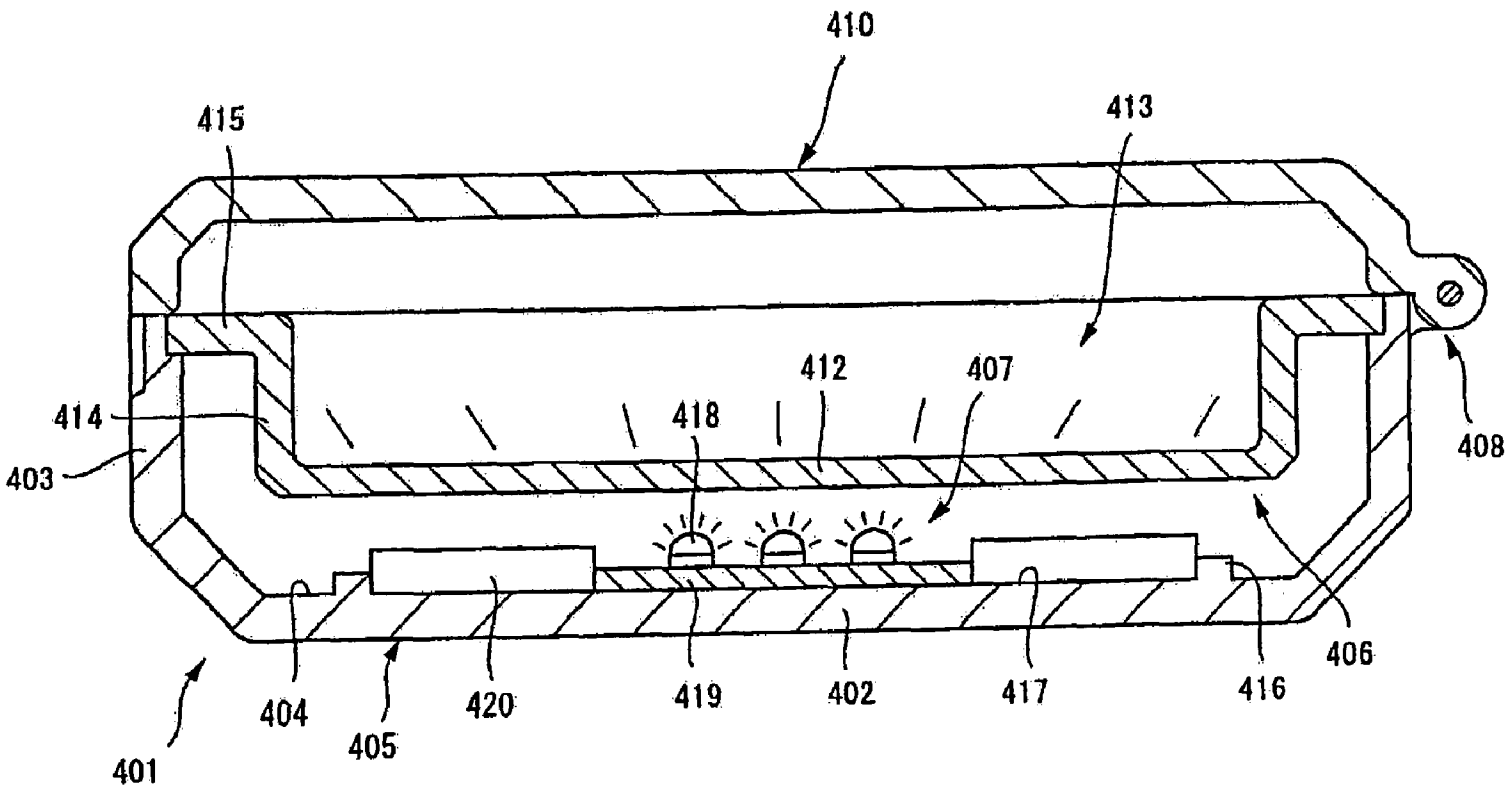
FIG. 16 is a side cross-sectional view of a storage case illustrated in FIG. 15.

FIGS. 15 and 16 illustrate Embodiment 5. In this embodiment, the storage space 413 of the inner dish 406 is to be mainly lit up by light of the RGB light source 418, and this is preferably applied as a storage case 401 to store jewelry and the like. In this embodiment, the case body 405 is formed of translucent material, and at the case body 405 side is provided a light source device 407 concealed from the outside by the bottom wall 402. On the other hand, the inner dish 406 is formed entirely of translucent material such as plastic, glass or crystal with color or with no color, and is transparent or semi-transparent, and the inner dish 406 is entirely formed as a light transmitting portion.

The inner dish 406 transmits the light of the RGB light source 418 into the storage space 413 or to the annular flange portion 415 around it, and the inner dish 406 is to be entirely lit up by the light. In the second embodiment, it is needless to say that similar effects as the first embodiment can be obtained.

Embodiment 6

Figure 17:
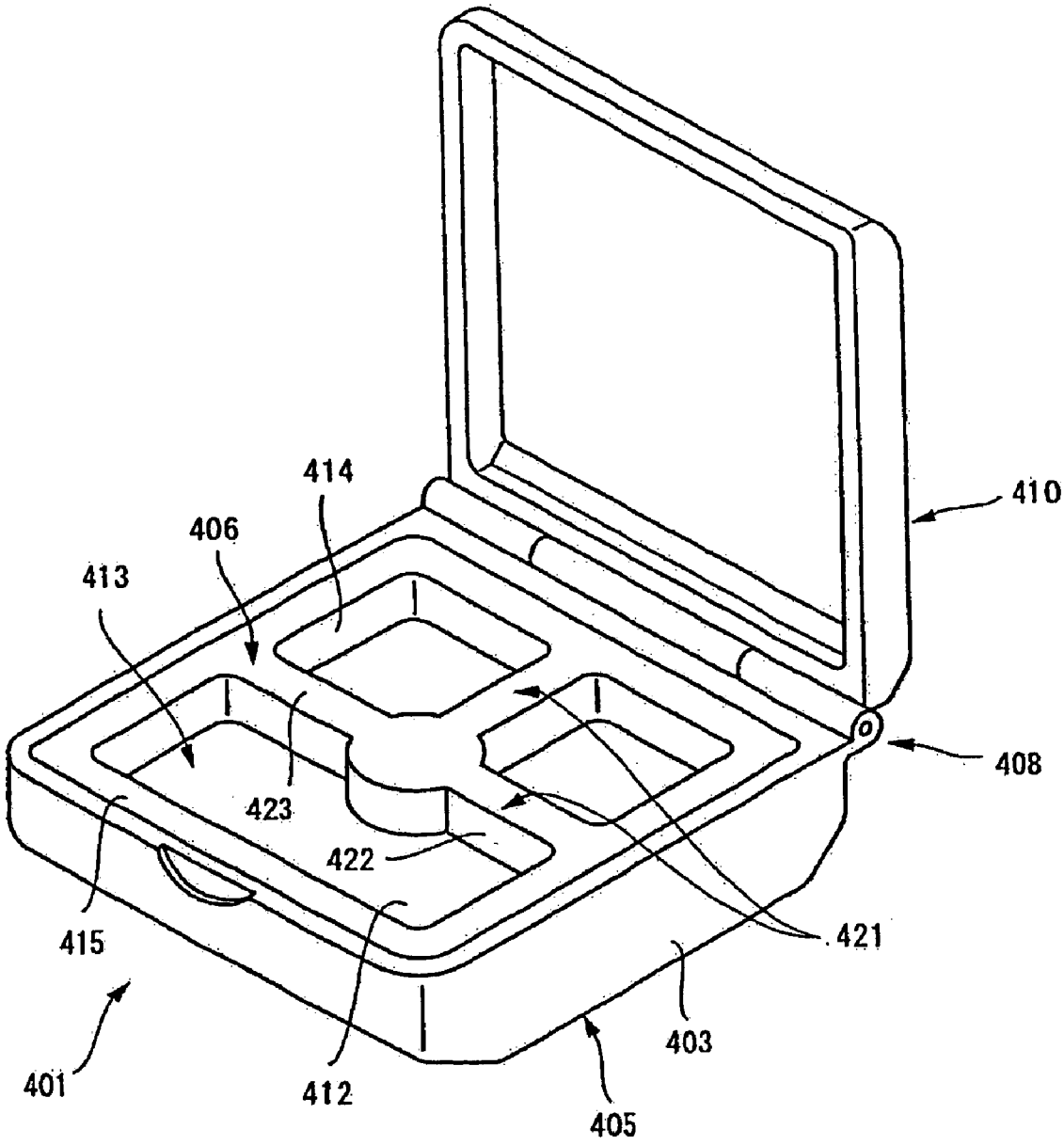
FIG. 17 is a perspective view illustrating a sixth embodiment of the storage case according to the present invention.
Figure 18:
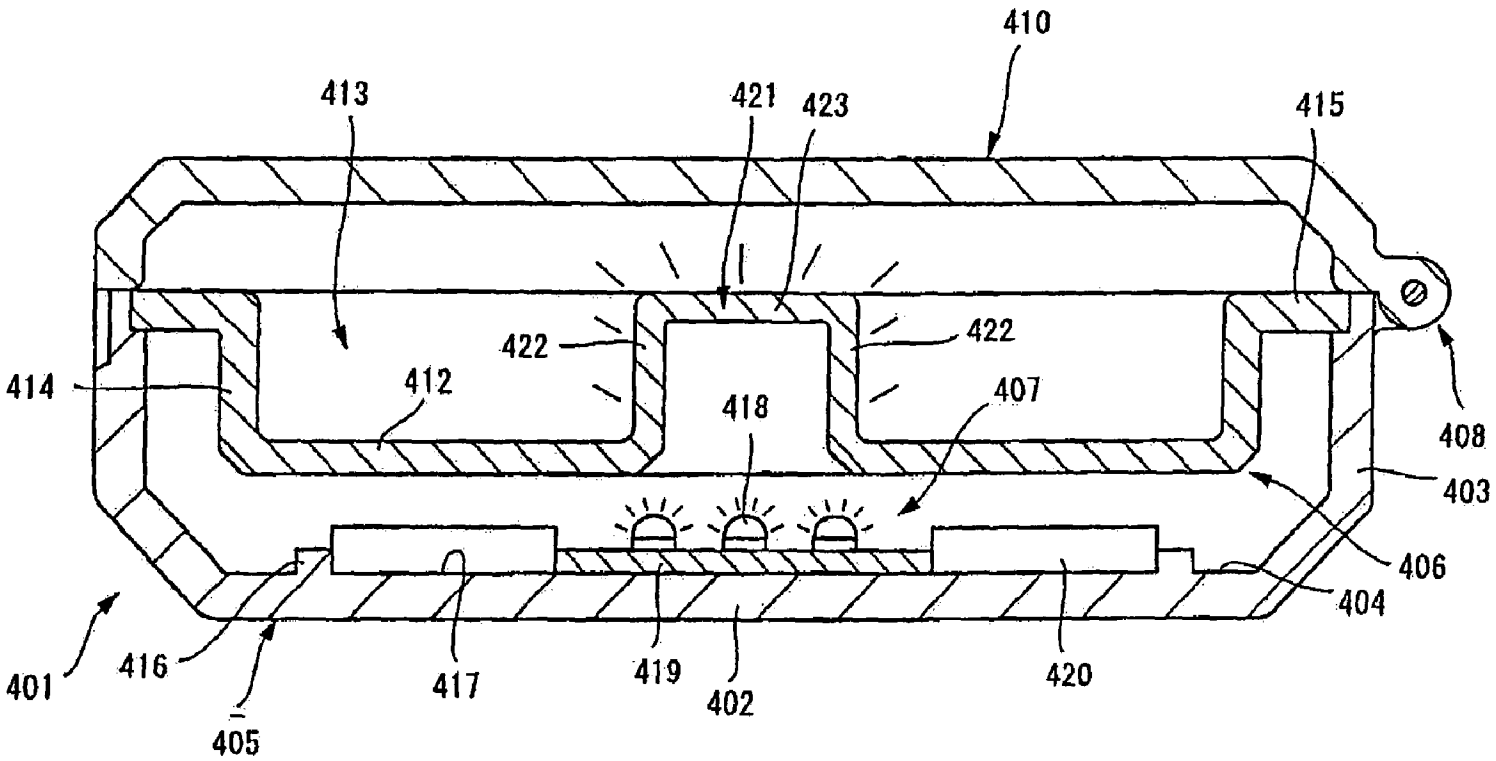
FIG. 18 is a side cross-sectional view of the storage case illustrated in FIG. 17.

FIGS. 17 and 18 illustrate a sixth embodiment. In this embodiment, the style of the inner dish 406 of the second embodiment has been changed, and there are formed partition walls 421 in the storage space 413 to divide the space vertically and horizontally. The partition walls 421 are formed as hollow constructions to connect the top ends of a pair of vertical walls 422 with a top plate 423. In the third embodiment, it is needless to say that similar effects as in the above embodiment can be obtained, and in particular as the partition walls 421 are also lit up by light of the RGB light source 418, the decoration effect can be further enhanced.

In any of the above embodiments, there is described a case where the case body 405 or the inner dish 406 is formed entirely of a translucent material, and it is to be entirely lit up, but it is needless to say that the light transmitting portion can be partially formed in the case body 405 or the like.

In a case the light transmitting portion is to be partially formed, the rest of the portion can be constructed to prevent light of the light source device 407, and for example, if a translucent mask such as a nontransparent sheet member or a resin molded portion partially formed with a stamped portion is provided by insert molding in the case body 405 or the inner dish 406, the stamped portion in the translucent mask can from a partial light transmitting portion. The translucent mask can also be formed by partially coating a non-transparent coating on the case body 405 or the like. The translucent mask can of course be made by methods such as by attaching a metal plate stamped out according to a design, or by sputtering While forming the case body 405 and the inner dish 406 entirely by a translucent plastic material, the light transmitting portion can be partially formed by integrating a translucent piece such as plastic, glass, or crystal, with color or with no color, and is transparent or semi-transparent in the case body 405 and the like. In this case, by utilizing insert molding, the translucent piece can be easily provided in a plastic case body 405 or the like.

By partially forming a light transmitting portion in this way, a light transmitting portion of various styles of letters or marks, or arbitrary shapes according to a desired design can be formed in the case body 405 or the like, and a superior decorated effect can be realized.

Embodiment 7

Figure 19:
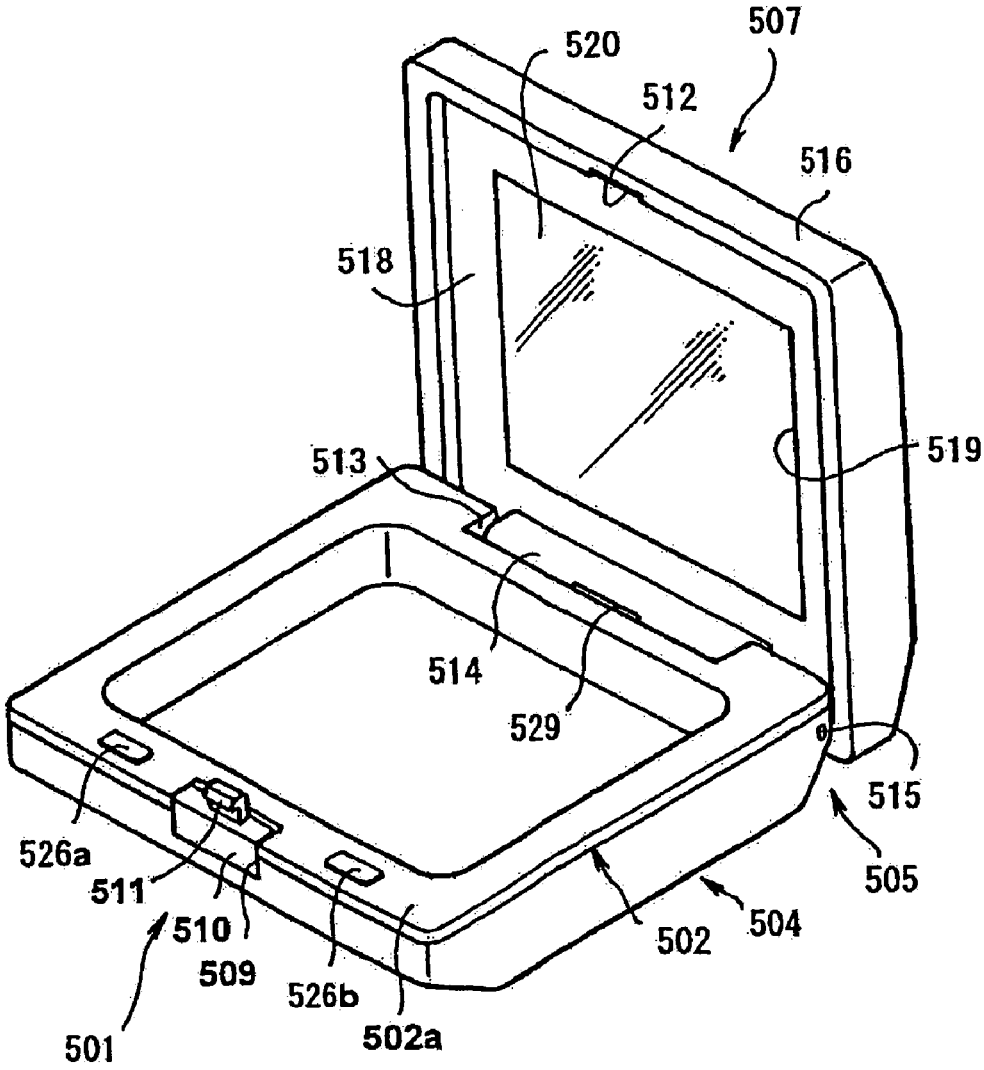
FIG. 19 is a perspective view illustrating a seventh embodiment of the storage case according to the present invention with the lid body in an open state.
Figure 20:
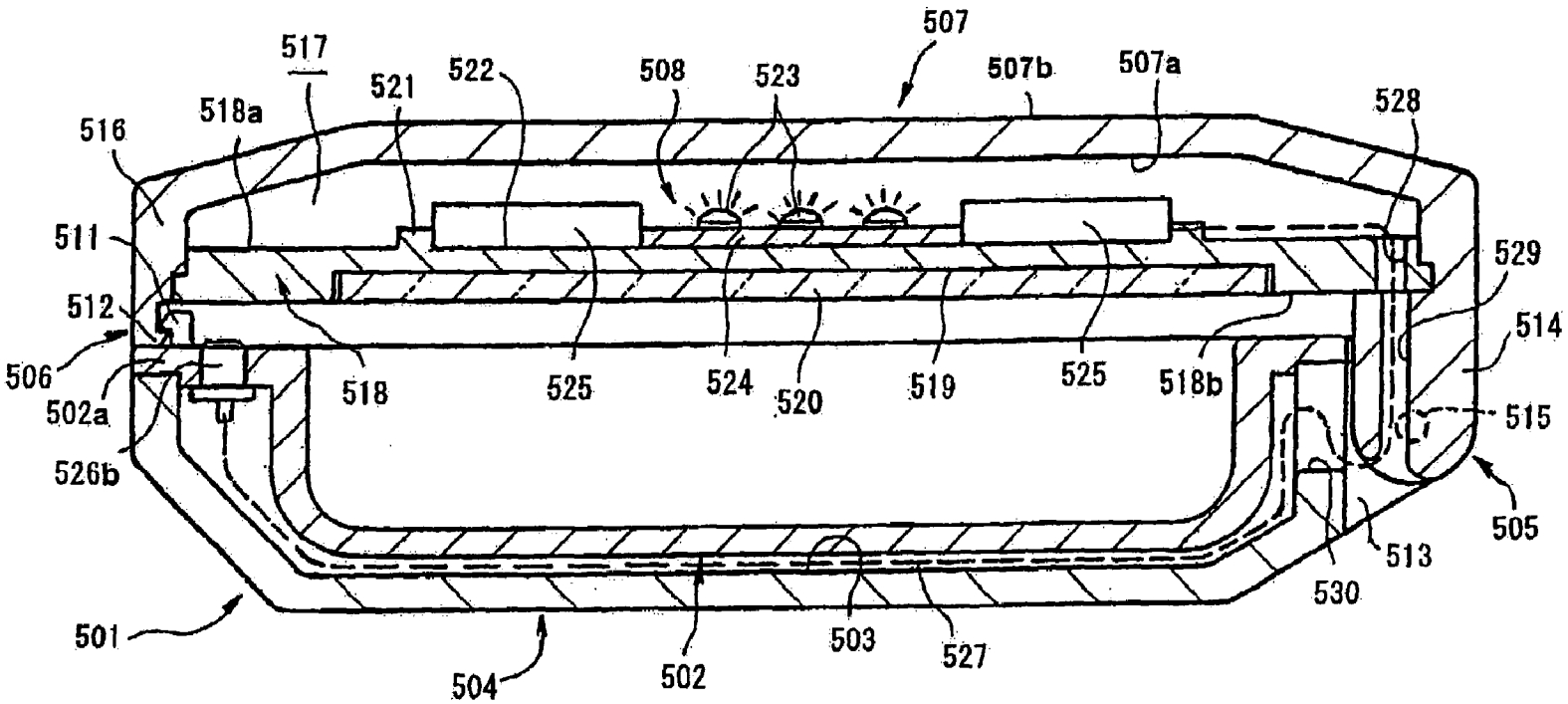
FIG. 20 is a side cross-sectional view of a storage case in FIG. 19.
Figure 21:
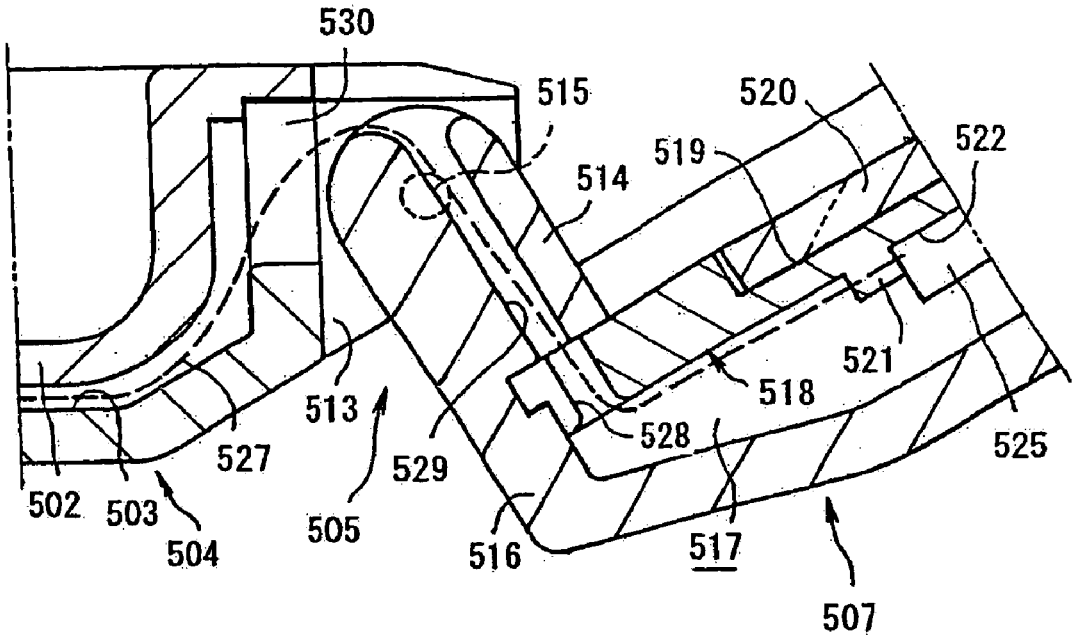
FIG. 21 is an enlarged side cross-sectional view of a hinge portion when the lid body of the storage case in FIG. 19 is open.

As illustrated in FIGS. 19-21, a storage case 501 according to this embodiment is mainly constructed of an inner dish 502 to store various contents, a case body 504 formed with a storage recess 503 to store the inner dish 502, a lid body 507 connected rotatably by a hinge 505 to one end of the case body 504 to open and close the case body 504, and to be engageably and detachably engaged by a hook means 506 to the other end of the case body 504 to retain the case body 504 in a closed state, and a light source device 508 provided at a back side of the lid body 507.

The hook means 506 is constructed of a push piece 510 provided in a notch portion 509 formed in the case body 504 to be able to slide, a hooking protrusion 511 formed on the push piece 510, and a hook portion 512 formed on the lid body 507 and to engage engageably and detachably with the hooking protrusion 511. The push piece 510 is pushed into the case body 504, to detach the hooking protrusion 511 from the hook portion 512, so that the lid body 507 can be opened. Further, the hinge 505 is constructed by a hinge block 514 which droops down from the lid body 507 being inserted in a hinge recess 513 formed in the case body 504 at an opposite side to the hook means 506, and by a hinge pin 515 being inserted through the case body 504 and by the hinge block 514.

In the illustrated example, as the storage case 501 there is illustrated a portable cosmetic container to store cosmetics or puff in the inner dish 502. However, the storage case 501 is not limited to such cosmetic container, and it is needless to say that it can be a container to store any contents such as jewelry or accessories.

In describing the lid body 507, the outer edge portion of the lid body 507 is formed with a peripheral wall 516 which droops towards the case body 504 side, and thus a back side 507*a* of the lid body 507 is formed with a compartment of a recessed portion 517 for assembly surrounded by the peripheral wall 516. The recessed portion 517 for assembly is provided attachably and detachably with a cover 518 to cover and seal it by an engaging and detaching mechanism which is not shown. A light source device 508 is attached to a back side 518*a* of the cover 518 opposing the back side 507*a* of the lid body 507 and covered by the cover 518.

The cover 518 in this embodiment is formed by a plastic material with color or no color, and which is transparent or non-transparent, so that the light of the light source device 508 can be transmitted therethrough to irradiate externally. The material of the cover 518 can also be glass or the like. The front side 518*b* of the cover 518 is formed with a recess 519 having a smaller outer dimension than an inner dimension of the peripheral wall 516 of the lid body 507, and the recess 519 is attached with a mirror plate 520 apart from the peripheral wall 516. Accordingly, the periphery of the mirror plate 520 is to be lit up by the light of the light source device 508 that is irradiated in the recessed portion 517 for assembly and which is transmitted through the cover 518.

Further, according to necessity, the lid body 507 can be formed by a plastic material which has no color or has color, and is transparent or semi-transparent, so that light of the light source device 508 can be transmitted and irradiated outside. In this way, the front side 507*b* of the lid body 507 can be lit up by irradiated light which transmits through the lid body 507. Further, the back side of the mirror plate 520 can be formed with a portion partially removed of silver plating so that light of the light source device 508 is to be irradiated from the mirror surface of the mirror plate 520 through the cover 518.

On the other hand, on the back side 518*a* of the cover 518 is formed an annular rib 521 in a position concealed by the mirror plate 520, and the light source device 508 is arranged in an indented portion 522 surrounded by the annular rib 521. The light source device 508 is constructed of an RGB light source 523 arranged directed towards the back side 507*a* of the lid body 507, an electronic substrate 524 mounted with an electronic component constructing a controller controlling the light emission amount of each of the colors of the RGB light source 523, and batteries 525 that are button-type batteries supplying electric power to the electronic substrate 524 and through the substrate to the RGB light source 523. The RGB light source 523 is directly mounted on the electronic substrate 524.

As the RGB light source 523, there can be applied various light sources that are conventionally known, for example, an LED or an organic electroluminescence (EL) element. As the electronic components constructing the controller, there is included a control elements such as an IC chip written in with a programming to control light emission of the RGB light source 523, and as electric power is supplied from the batteries 525, the RGB light source 523 is made to emit light according to the programming.

To cause the RGB light source 523 to emit light, for example, the entire light emission amount can be increased and decreased, to make the light source blink slowly, and while it is blinking, the light emission rate in red, green, and blue can be subsequently changed to emit light in various colors, or the light source can be made to blink in short time intervals to change color each time to emit light, and any kind of programming can be stored in the control element. The light source is not limited to the RGB light source 523, and it is needless to say that and it can be a monochromatic light source.

On the other hand, in this embodiment, the case body 504 is provided with pressure-sensitive sensors 526*a*, 526*b* as control operation portions to control the controller. In the illustrated diagram, the sensors 526*a*, 526*b* are provided in two places with a push-piece 510 in between, at a front edge portion 502*a* of the inner dish 502 attached to the case body 504. In regards to these sensors 526*a*, 526*b*, for example, one functions as a power supply switch, and the other functions as a transfer switch to change the light emission state. The sensor 526*b* which functions as a transfer switch, controls the controller, for example, according to the number of times pressed, and makes any of the RGB light source 523 emit light and change color, or changes the way of various light emissions described above.

These sensors 526*a*, 526*b* and the light source device 508 are connected via a lead wire 527. The lead wire 527 is wired from the recessed portion 517 for assembly of the lid body 507 in the space between the case body 504 and the inner dish 502, through a hole 528 formed in the cover 518, a slit 529 formed in the hinge block 514 connected to the hole 528, and a passage 530 formed at a rear end portion of the case body 504 near the hinge block 514, and one end is connected to a battery 525 and the other end is connected to the sensors 526*a*, 526*b*.

In the illustrated example, there are provided two sensors 526*a*, 526*b*, but a single sensor for both ON and OFF operations can be provided. Further, instead of the sensors 526*a*, 526*b*, a button-type switch can be provided. Further, the sensors 526*a*, 526*b* are provided in the case body 504, but they can be provided in the lid body 507.

Next, the operation of the storage case 501 of this embodiment comprising the above structure is described. When the lid body 507 is opened and one of the sensors 26*a* which functions as a power supply switch is touched, electric power is supplied from the battery 525 to the RGB light source 523 or the electronic substrate 524. Then, when the other sensor 526*b* which functions as a transfer switch is touched, the controller is controlled, and the RGB light source 523 emits light in various colors and brightness while blinking and the like, according to the programming written in the control element.

The light of the RGB light source 523 lights up the back side 507*a* of the opened lid body 507 in various styles through the cover 518. Further, irradiated light of the RGB light source 523 is transmitted through the lid body 507 and lights up its front side 507*b*. On the other hand, when one of the sensors 26*a* is again touched, the RGB light source 523 is turned off.

Thus, the storage case 501 according to this embodiment as described above, is made to control the controller which controls light emission of the RGB light source 523 by the sensors 526*a*, 526*b* which are control operation portions, so that the light emission of the RGB light source 523, as well as of course ON and OFF of the RGB light source 523 can be changed according to taste, and thus various effects by light that appeal to vision can be freely obtained according to the selection of a user operating the sensors 526*a*, 526*b*, and the storage case 501 can be decorated to be aesthetically pleasing, or original and novel to give a characteristic and unique atmosphere.

That is, by controlling the controller with the sensors 526*a*, 526*b*, various visual effects by irradiated light of the RGB light source 523 can be switched, and even with the same product, the appearance given by effect of the light can be changed according to the user's taste.

Further, a transparent or semi-transparent cover 518 that transmits light and covers the light source device 508 is provided on the lid body 507, so light passes through the cover 518 to be diverged, and various visual effects such as light divergence or diffused reflection can be added.

Further, the lid body 507 is formed to be transparent or semi-transparent to transmit light, and the external appearance of the lid body 507 can be decorated with a characteristic atmosphere using the effect of light.

Embodiment 8

Figure 22:
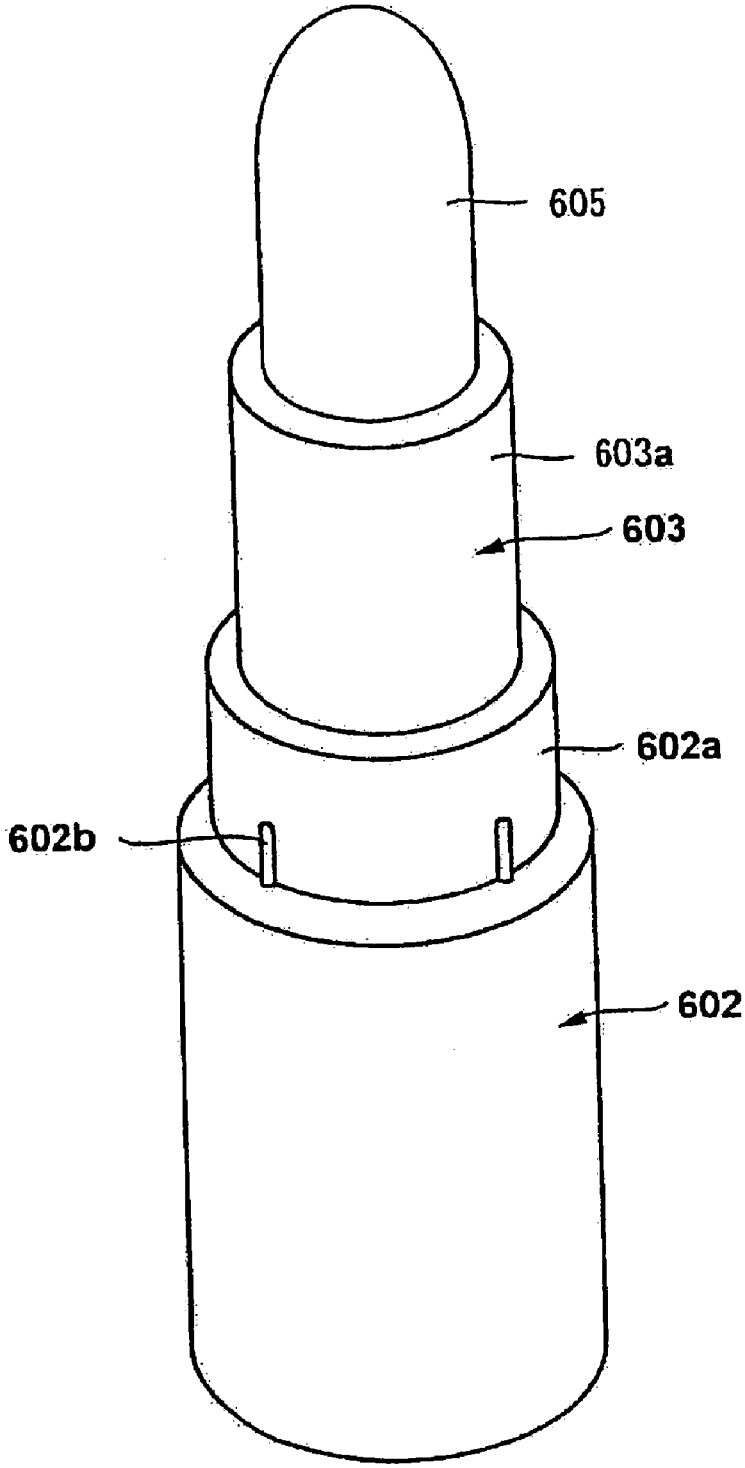
FIG. 22 is a perspective view illustrating a preferred embodiment mode of a roll-up type rod-shaped storage case according to the present invention.
Figure 23:
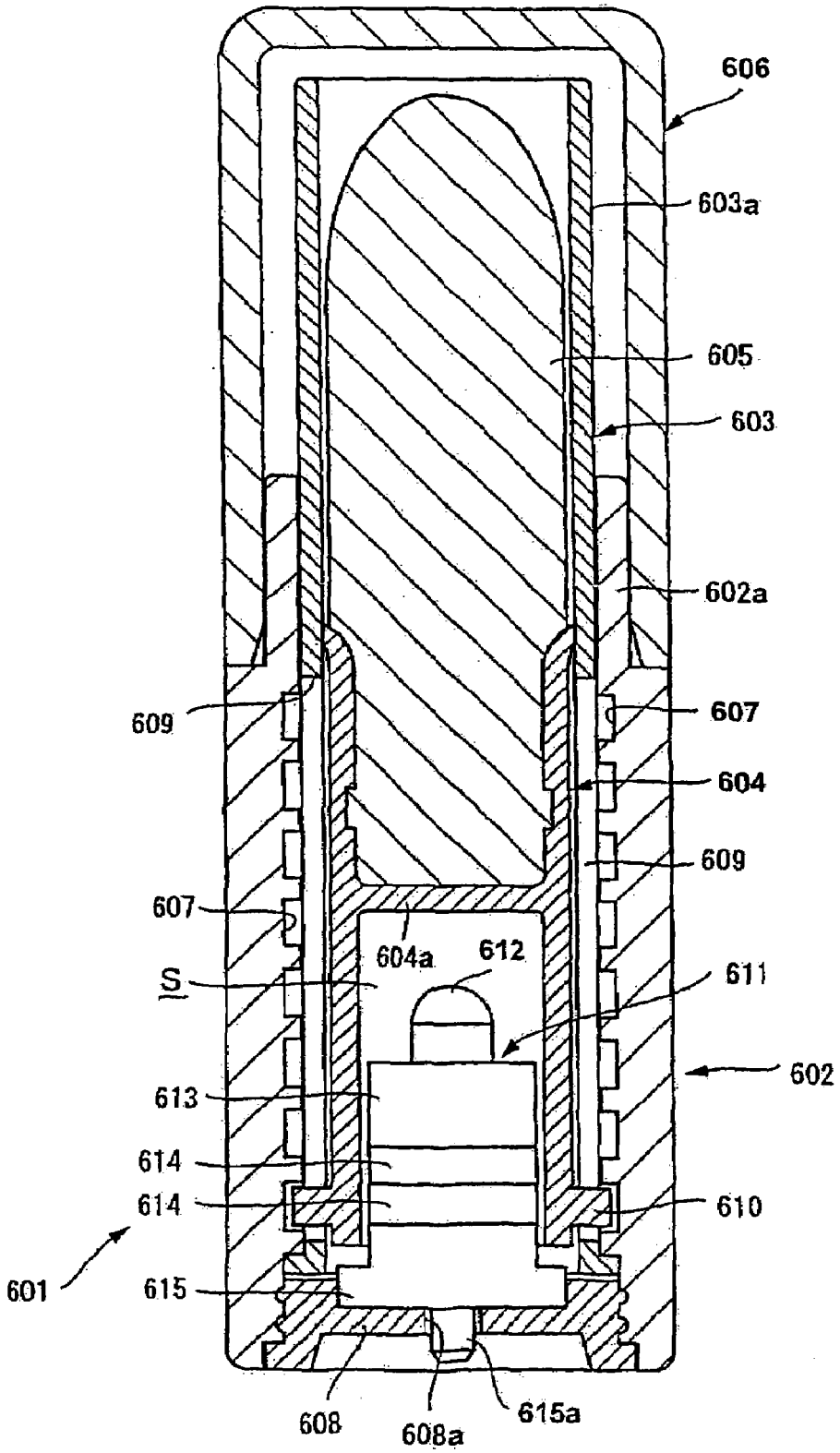
FIG. 23 is a side cross-sectional view of the roll-up type rod-shaped storage case in FIG. 22.
Figure 24:
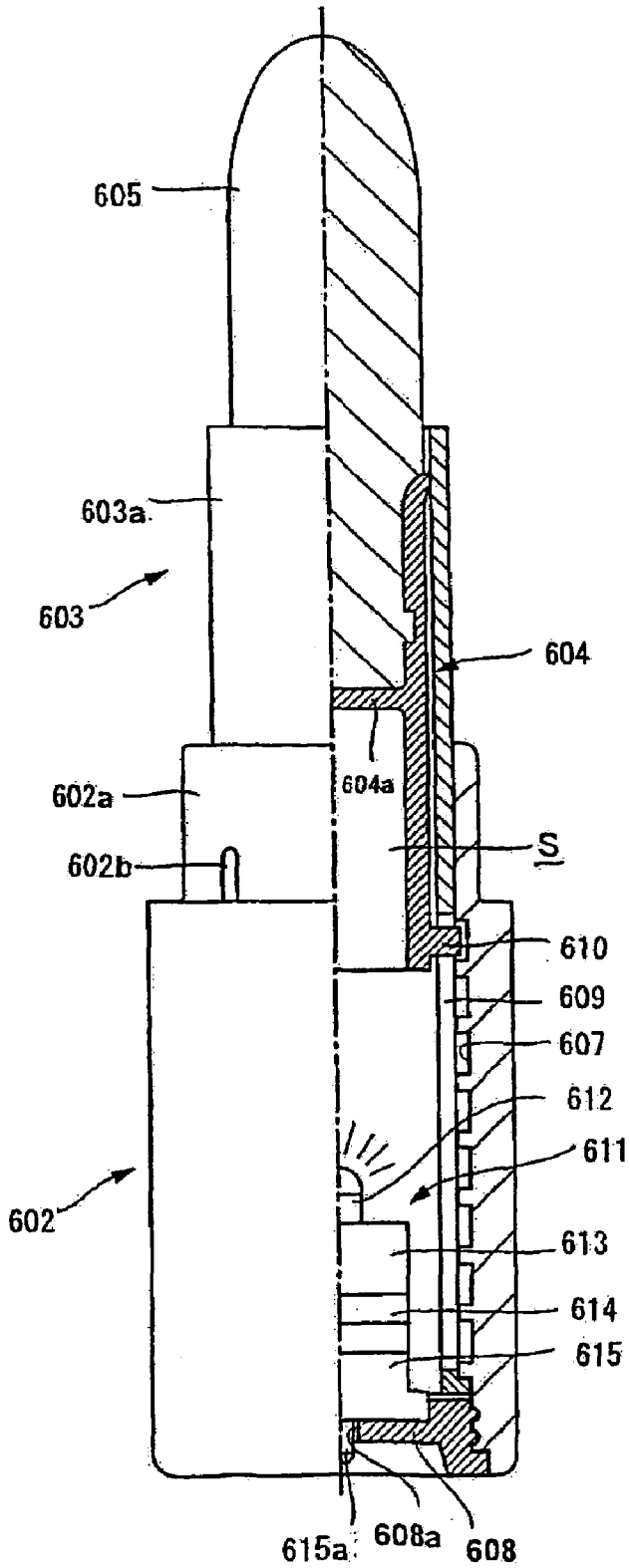
FIG. 24 is a partially cutaway side cross-sectional view illustrating a state in which the rod-shaped object is pushed up by the roll-up type rod-shaped storage case in FIG. 22.

The present embodiment illustrates a roll-up type storage case for a rod-shaped object. As illustrated in FIGS. 22 to 24, a storage case 601 is schematically constructed, with an inner side of a hollow cylindrical shape case body 602 provided with a hollow cylindrical shape cover 603, and an inner side of the cover 603 provided with a hollow cylindrical shape holding member 604, and the holding body 604 is to hold a rod-shaped object 605 such as a lipstick. A top end portion 602*a* of the case body 602 having a small diameter is to be attached attachably and detachably with a cap 606 to cover a top portion of the cover 603.

In the illustrated example, as the roll-up type rod-shaped storage case 601, there is illustrated a lipstick container to hold a lipstick as the rod-shaped object 605 in the holding body 604. However, the roll-up type rod-shaped object storage case 601 is not limited to such a lipstick case, and it is needless to say that it can store any kind of rod-shaped object 605.

The case body 602 is formed with open top and bottom ends, and its inner periphery is formed with a helical groove 607 in a vertical direction which is the shaft direction, for an appropriate length corresponding to the roll-up amount of the rod-shaped object 605. The open lower end of the case body 602 is screwed on attachably and detachably with a ring shaped bottom plate 608. With the cover 603 attached to the case body 602, the top end portion 603*a* of the cover 603 protrudes outwardly from the top end portion 602*a* of the case body 602. Further, at a portion where the cover 603 is surrounded by the case body 602, there are formed vertical slits 609 corresponding to portions formed with the helical groove 607.

The holding body 604 is formed having a dividing portion 604*a* in a center portion in a vertical direction, and with open upper and lower ends, and is provided relatively movably in the vertical direction at an inner side of the cover 603. An outer side of the lower end portion of the holding body 604 is provided to protrude integrally protrusions 10 which pass through the vertical slits 609 and engage the helical groove 607. Further, the rod-shaped object 605 is held above the dividing portion 604*a* of the holding body 604. The cap 606 is formed as a hollow 20, cylindrical shape with the top end closed. The cap 606 is fitted to ribs 602*b* formed in the top end portion 602*a* of the case body 602, to be attachably and detachably attached to the case body 602.

In respect to the above constructed roll-up type rod-shaped object storage case 601 in this embodiment, in a state the rod-shaped object 605 is stored and the cap 606 is attached as illustrated in FIG. 23, the case body 602 and the cap 606 form the external appearance, and the cover 603 and the holding body 604 are concealed therein. On the other hand, at the time of rolling out the rod-shaped object 605, the cap 606 is taken off and the case body 602 and the cover 603 are relatively rotated, for example, the case body 602 is rotated to the right, so the protrusions 10 of the holding body 604 which pass through the vertical slits 609 moves along the helical groove 607. Then, as illustrated in FIGS. 22 to 24, the holding body 604 is rolled up upwardly, and the rod-shaped object 605 is made to protrude from the upper end portion 603*a* of the cover 603. Further, when storing the rod-shaped object 605, the case body 602 and the cover 603 are relatively rotated in opposite directions, for example, the case body 602 is rotated to the left, and the protrusions 10 move in the opposite direction along the helical groove 607 to roll down the holding body 604, to store the rod-shaped object 605 in the cover 603.

In particular, the roll-up type rod-shaped storage case 601 according to this embodiment is provided with a light source device 611 inside the case body 602, and the cover 603 and the holding body 604 are formed with light transmitting portions to transmit light of the light source device 611. The light source device 611 is provided attached above a ring body 608 in a space S formed as a compartment below the dividing portion 604*a* of the holding body 604 which moves vertically inside the case body 602.

The light source device 611 is constructed of an RGB light source 612 arranged to be surrounded at the periphery by the holding body 604, the cover 603, and case body 602, an electronic substrate 613 mounted with electronic components constructing a controller to control light emission amount of each color of the RGB light source 612, batteries 614 such as button-type batteries to supply electric power to the electronic substrate 613 and through this to the RGB light source 612, and a switch 615 to interrupt electric power supply from the batteries 614 to the electronic substrate 613 and the like, which are arranged vertically on top of each other, and the components can be exchanged by detaching the ring body 608. The RGB light source 612 is directly mounted above the electronic substrate 613. Further, an operation push button 615*a* of the switch 615 is exposed downwardly, through a hole portion 608*a* of the ring plate 608.

As the RGB light source 612, there can be applied various light sources that are conventionally known, for example, an LED or an organic electroluminescent (EL) element. As the electronic components constructing the controller, there is included a control element such as an IC chip written in with a programming to control light emission of the RGB light source 612, and as electric power is supplied from the batteries 614 by a switch 615, the RGB light source 612 is made to emit light according to the programming.

To cause the RGB light source 612 to emit light, for example, the entire light emission amount can be increased and decreased, to make the light source blink slowly, and while it is blinking, the light emission rate in red, green, and blue can be subsequently changed to emit light in various colors, or the light source can be made to blink in short time intervals to change color each time to emit light, and any kind of programming can be stored in the control element. The light source is not limited to the RGB light source 612, and it is needless to say that it can be a monochromatic light source.

On the other hand, in regards to the light transmitting portion formed in the cover 603 and the holding member 604 in this embodiment, the cover 603 and the holding member 604 themselves are formed of a plastic material which has no color or has color, and is transparent or semi-transparent, and it is constructed to function entirely as the light transmitting portion. However, in regards to the light transmitting portion, a portion of the cover 603 or the holding member 604 can be formed of translucent material such as plastic, glass, or crystal which has transparency and the rest of the portion can be formed of translucent material, and the light transmitting portion can be partially form in the cover 603 or the like. In this case, for example at the time of insert molding, that is when the cover 603 and the like is inject molded by a plastic material, it can be manufactured by a method where a translucent material is attached inside a mold in advance, and integrated with the injected translucent plastic material.

Next, an operation of a roll-up type rod-shaped object storage case 601 of this embodiment comprising the above construction is described. When the switch 615 is turned on with the cap 606 removed from the case body 602, electric power from the batteries 614 to the RGB light source 612 or the electronic substrate 613 is supplied, and the RGB light source 612 emits light in various colors or brightness while blinking or the like, according to a programming written in the control element. As illustrated in FIG. 23 the light of the RGB light source 612, is irradiated to the holding member 604 or the cover 603 surrounding the RGB light source 612, and to be transmitted therethrough to light up the cover 603 and the light in diverse styles.

In particular, when the holding member 604 is rolled up and the rod-shaped object 605 is protruded from the case boy 602, as illustrated in FIG. 24, the rod-shaped object 605 and a divider portion 604*a* of the holding member 604 rise to an appropriate vertical position, so that light is cut off less by the rod-shaped object 605, and the light of the RGB light source 612 can light up the top end portion 603*a* of the cover 603 which is protruding from the top end portion 602*a* of the case body 602 with a stronger light. On the other hand, when the switch 615 is turned off, the RGB light source 612 is turned off.

In regards to the roll-up type rod-shaped storage case 601 according to this embodiment as described above, a light source device 611 is provided inside the case body 602, and the cover 603 and the holding body 604 are formed as translucent, and the light of the RGB light source 612 emitted inside the case body 602 is transmitted through the cover 603 provided in the case body 602 and the holding member 604 provided in the cover 603 to light them up. Thus, the cover 603 and the holding member 604 can be decorated in various ways using light, and the roll-up type rod-shaped object storage case 601 can be decorated with an aesthetically pleasing, or original and novel effect to give a characteristic and unique atmosphere.

Further, the light emission of the RGB light source 612 is to be controlled by the controller, and thus a diverse effect by light which appeals to vision can be obtained, and the roll-up type rod-shaped object storage case 601 can be decorated as aesthetically pleasing or original and novel to give a characteristic and unique atmosphere.

Figure 25:
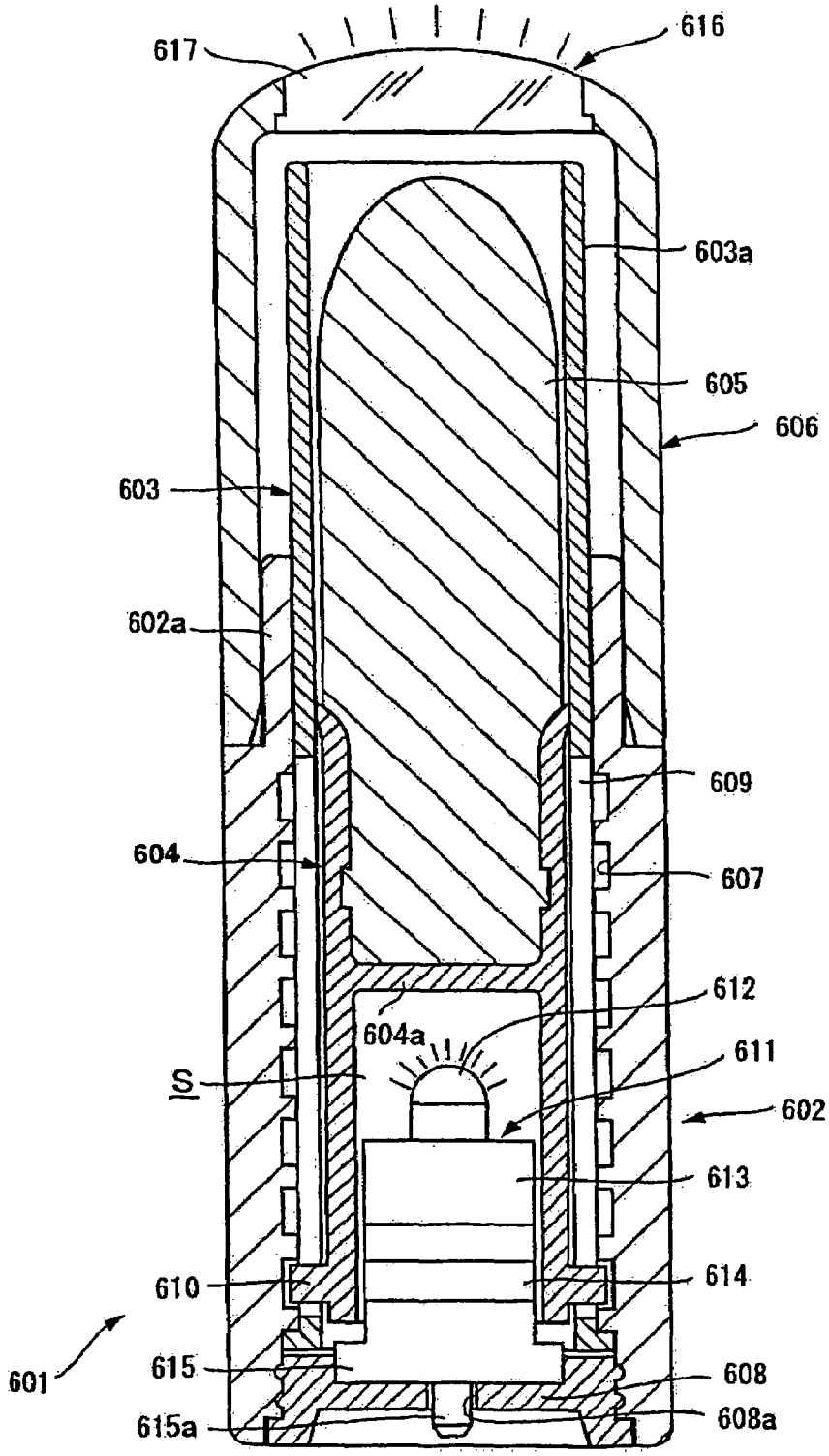
FIG. 25 is a side cross-sectional view illustrating a modified example of a roll-up type rod-shaped storage case according to the present invention.

In FIG. 25, there is illustrated a modified example of the cap 606. In the modified example, the cap 606 is formed with a light transmitting portion 16 to transmit light of the RGB light source 612 which has transmitted through the cover 603. In the illustrated example, a translucent member 617 is integrally provided on a top surface of the cap 606. As the translucent member 617, there can be used plastic, glass, or crystal, with no color or with color, and is transparent or semi-transparent, and this can be integrated in the cap 606 by insert molding. In such a modified example, it is needless to say that similar effects as the above embodiment can be obtained.

In particular, in this modified example, when the case body 602 is attached with the cap 606 to cover the cover 603 and the like, the light of the RGB light source 612 which is emitted inside the case body 602 lights up the translucent member 617 of the cap 606 through the cover 603 or the holding member 604, and even when the rod-shaped object 605 attached with the cap 606 is not in use various decorations using light can be obtained, and the roll-up type rod-shaped object storage case 601 can be decorated with an aesthetically pleasing or original and novel effect to give a characteristic and unique atmosphere. Of course, the cap 606 can be entirely formed of a translucent material.

Further, the case body 602 can be formed with a light transmitting portion to transmit light of the RGB light source 612. In this way, the light of the RGB light source 612 emitted inside the case body 602 can light up not only the cover 603, the holding body 604, and the cap 606, but also the front side of the case body 602, and in this way various decorations using light can be obtained, and the roll-up type rod-shaped object storage case 601 can be decorated with an aesthetically pleasing or original and novel effect to give a characteristic and unique atmosphere. In regards to the case body 602, it is needless to say that it can be entirely formed of translucent material.

Embodiment 9

Figure 26:
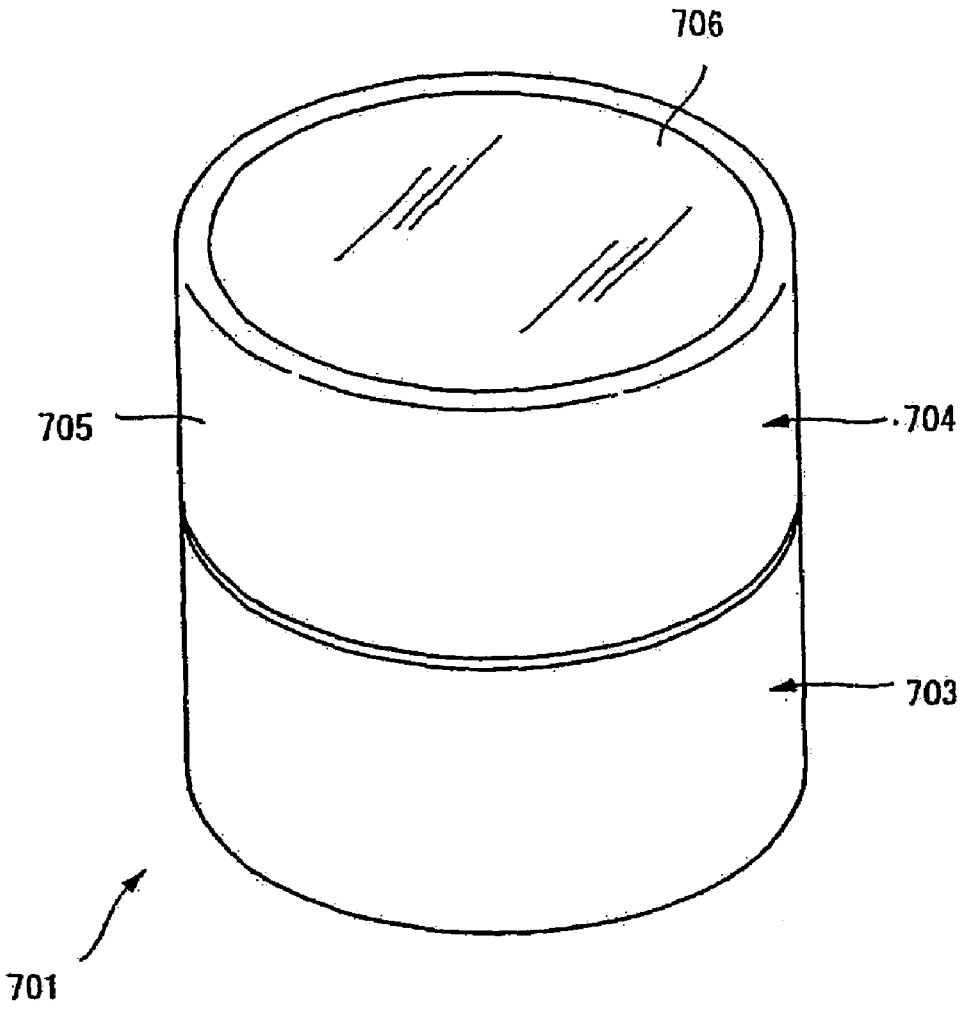
FIG. 26 is a perspective view illustrating a ninth embodiment of the storage case according to the present invention.
Figure 27:
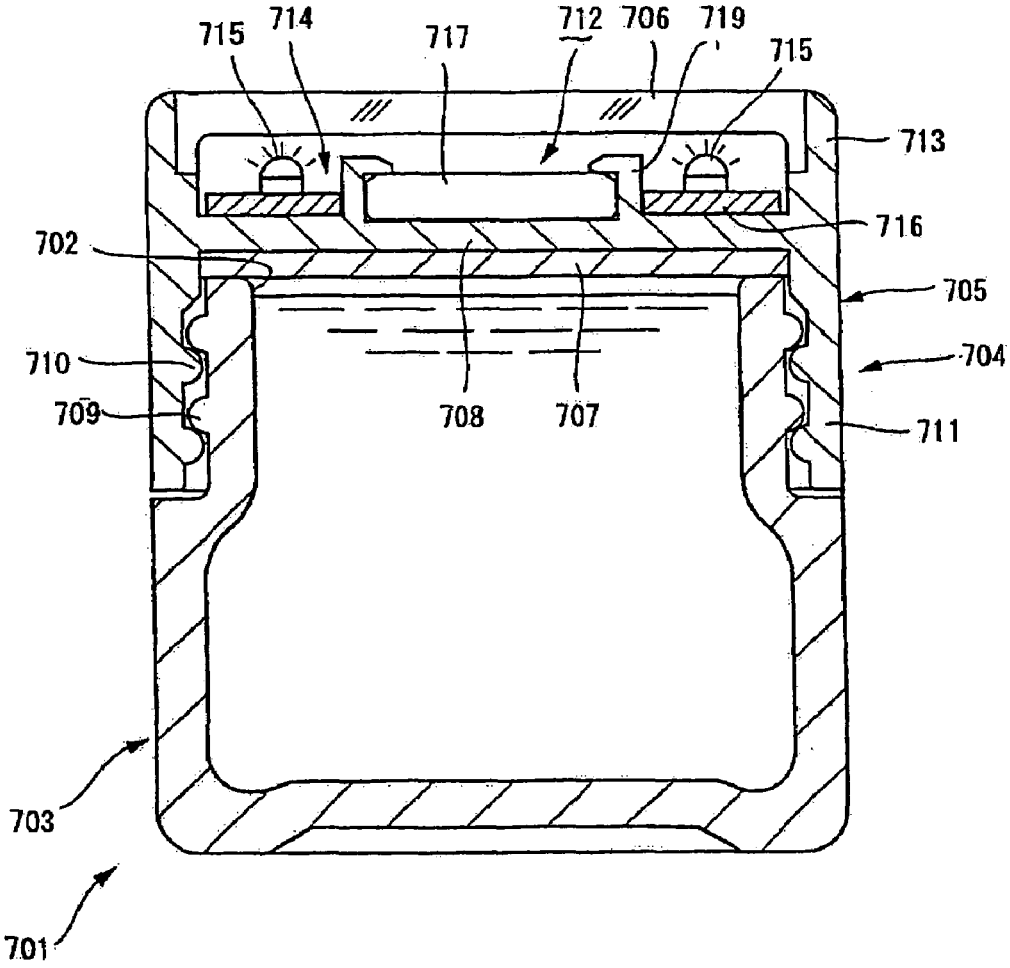
FIG. 27 is a side cross-sectional view of the storage case illustrated in FIG. 26.

A storage case 701 as illustrated in FIGS. 26 and 27 according to the present embodiment is formed with an opening 702 in a top end portion, and is mainly constructed of a cylindrical case body 703 to store liquid, powder or cream inside as contents, and a lid body 704 formed cylindrically along a plane outer contour of the case body 703, to be detached separably from the case body 703 to open and close the opening 702.

In describing the lid body 704, it is constructed of a detachable piece 705 to be detached from the case body 703, and a cover 706 which is attached to the detachable piece 705. The detachable piece 705 is constructed of a disk lid portion 708 with a seal packing 707 at a bottom side to be pressure contacted with an outer edge of the opening 702 of the case body 703, an annular skirt portion 711 which droops downwardly from a peripheral edge of the lid portion 708 and is formed with a screw portion 710 to be engaged with a screw portion 709 formed in a top end portion of the case body 703, and an annular peripheral wall portion 13 which rises upwardly from the peripheral wall of the lid portion 708 and forms inside a compartment as a recess 712 that opens upwardly.

The lid body 704 is attached or detached separably from the case body 703 by the screw portion 710 being screwed to the screw portion 709 of the case body 703, and thus the case body 703 and the opening 702 is to be opened and closed by the lid body 704. However, attachment of the lid body 704 to the case body 703 is not limited to the use of screw portions 709, 710, and it is needless to say that attachment can be carried out by a known fitting or the like. The cover 706 is formed in a disk shape along an inner periphery of the annular peripheral wall portion 13, and is attachably and detachably attached inside the annular peripheral wall portion 13 to cover the recess 712.

In this embodiment, there is provided a light source device 714 built-in inside the lid body 704 in between the attachable and detachable piece 705 and the cover 706 attached thereon. Specifically, there is provided the light source device 714 mounted on a top surface of the lid portion 708 which is a bottom surface of the recess 712 covered by the cover 706. The light source device 714 is constructed of RGB light sources 715 formed of a plurality of light elements and arranged towards the cover 706 covering the recess 712, an electronic substrate 716 mounted with electronic components constructing a controller controlling light emission amount of each color of the RGB light source 715, and a battery 717 such as a button-type battery to supply electric power to the electronic substrate 716 and through this to the RGB light source 715.

In the illustrated example, in a center portion of the top surface of the lid portion 708 is formed an engaging claw 719 which protrudes in a hook shape to attachably and detachably hold the battery 717, and on the outer edge portion of the lid portion 708 surrounding the engaging claw 719 is attached an electronic substrate 716 formed in an annular shape, and on the annular electronic substrate 716 is directly mounted in a peripheral direction a plurality of light elements (the RGB light sources 715) with appropriate intervals therebetween.

As the light elements of the RGB light sources 715, there can be applied various light sources that are conventionally known, for example, an LED or an organic electroluminescent (EL) element. As the electronic components constructing the controller, there is included a control element such as an IC chip written in with a programming to control light emission of the RGB light source 715, and as electric power is supplied from the batteries 717 by a switch that is not shown, the RGB light source 715 is made to emit light according to the programming.

To cause the RGB light source 715 to emit light, for example, the entire light emission amount can be increased and decreased, to make the light source blink slowly, and while it is blinking, the light emission rate in red, green and blue can be subsequently changed to emit light in various colors, or the light source can be made to blink in short time intervals to change color each time to emit light, and any kind of programming can be stored in the control element. The light source is not limited to the RGB light source 715, and it is needless to say that and it can be a monochromatic light source.

Further, although the switch is not illustrated, for example, both a manual main switch and a manual sub-switch can be provided on the lid body 704 to switch actuation and deactuation of the light source device 714 by turning on and off the main switch, and to switch emitting of light and turning off of light by turning on and off the sub-switch, and by turning the sub-switch "on" with the main switch in an "on" state, the RGB light source 715 can be made to emit light. In regards to the sub-switch, there can be provided contact points in the screw portions 709, 710 of the lid body 704 and the case body 703 that are made to be in electrical continuity with the battery 717, and the contact points come into contact when the lid body 704 is in a position screwed in a certain extent, so that the RGB light source 715 can be made to emit light. Of course, just the main switch can be provided, so that light can be emitted with only the on and off operation.

In particular, the lid body 704 is formed with a light transmitting portion to transit light of the RGB light sources 715. In this embodiment, the attachable and detachable 705 is formed of a translucent material which is metallic, plastic or the like and does not transmit light, or is applied with translucent coloring, and the entire cover 706 which constructs the lid body 704 can be formed of translucent material such as plastic, glass, or crystal, with no color or with color, and is transparent or semi-transparent, so as to form the cover 706 entirely as the light transmitting portion. The cover 706 irradiates light of the RGB light source 715 from inside the recess 712 outwardly, so that it is lit up entirely by the light.

Next, the operation of the storage case 701 of this embodiment comprising the above constructions is described. When the main switch which is not shown is turned on, electric power is supplied from the battery 717 to the RGB light sources 715 and the electronic substrate 716, and the RGB light sources 715 emit light in various colors and brightness while blinking or the like, according to a programming written in the control element. The light of the RGB light sources 715 is irradiated externally from the entire cover 706 which is a light transmitting portion, and lights up the entire front side of the cover 706 of the lid body 704 forming a portion of the external appearance of the storage case 701 in various styles. When the main switch is turned off, the RGB light source 715 is turned off.

In regards to the storage case 701 according to this embodiment described above, the light of the light source device 714 provided between the attachable and detachable piece 705 and the cover 706 is transmitted outwardly from the cover 706 formed entirely of a translucent material, and the front side of the cover 706 is to be entirely lit up. In this way, the cover 706 of the lid body 704 which forms a portion of the front side of the storage case 701 can be decorated with a diverse decoration using light, and the storage case 701 can be decorated with an aesthetically pleasing or original and novel effect to give a characteristic and unique atmosphere.

Further, the light source device 714 is constructed of the RGB light source 715, the electronic substrate 716 mounted with the controller to control light emission of the RGB light source 715, and the battery 717 to supply electric power to the electronic substrate 716 and the RGB light sources 715, and the controller is made to control light emission of the RGB light sources 715, so that various effects by light which appeals to vision can be realized, and the storage case 701 can be decorated to be aesthetically pleasing, or original and novel to give a characteristic and unique atmosphere.

Further, the lid body 704 is constructed of the attachable and detachable piece 705 and the cover 706, and there is provided therebetween the light source device 714, and an assembling operation of the light source device 714 to the lid body 704 can be made easier. In this embodiment, the cover 706 is provided attachably and detachably to the attachable and detachable piece 705, so that exchange of the battery 717 or the like can be easily performed.

Embodiment 10

Figure 28:
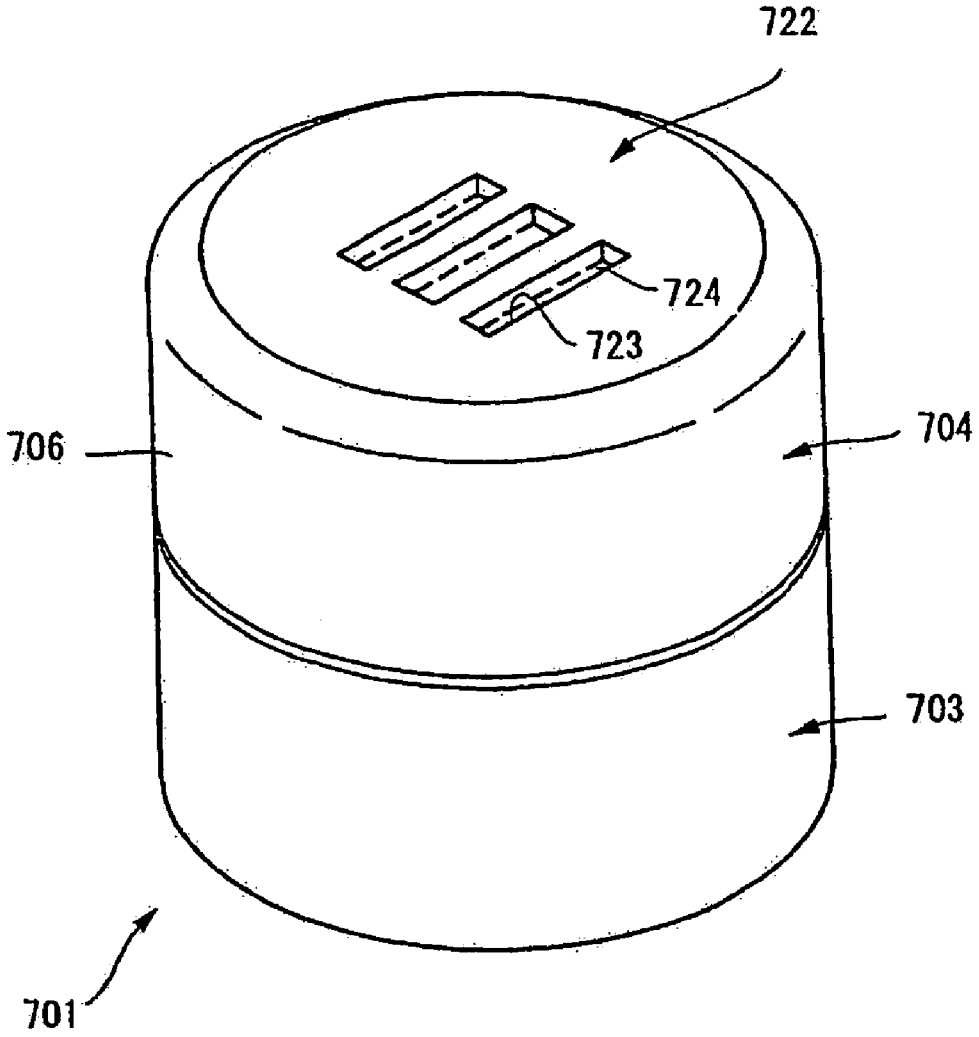
FIG. 28 is a perspective view illustrating a tenth embodiment of the storage case according to the present invention.
Figure 29:
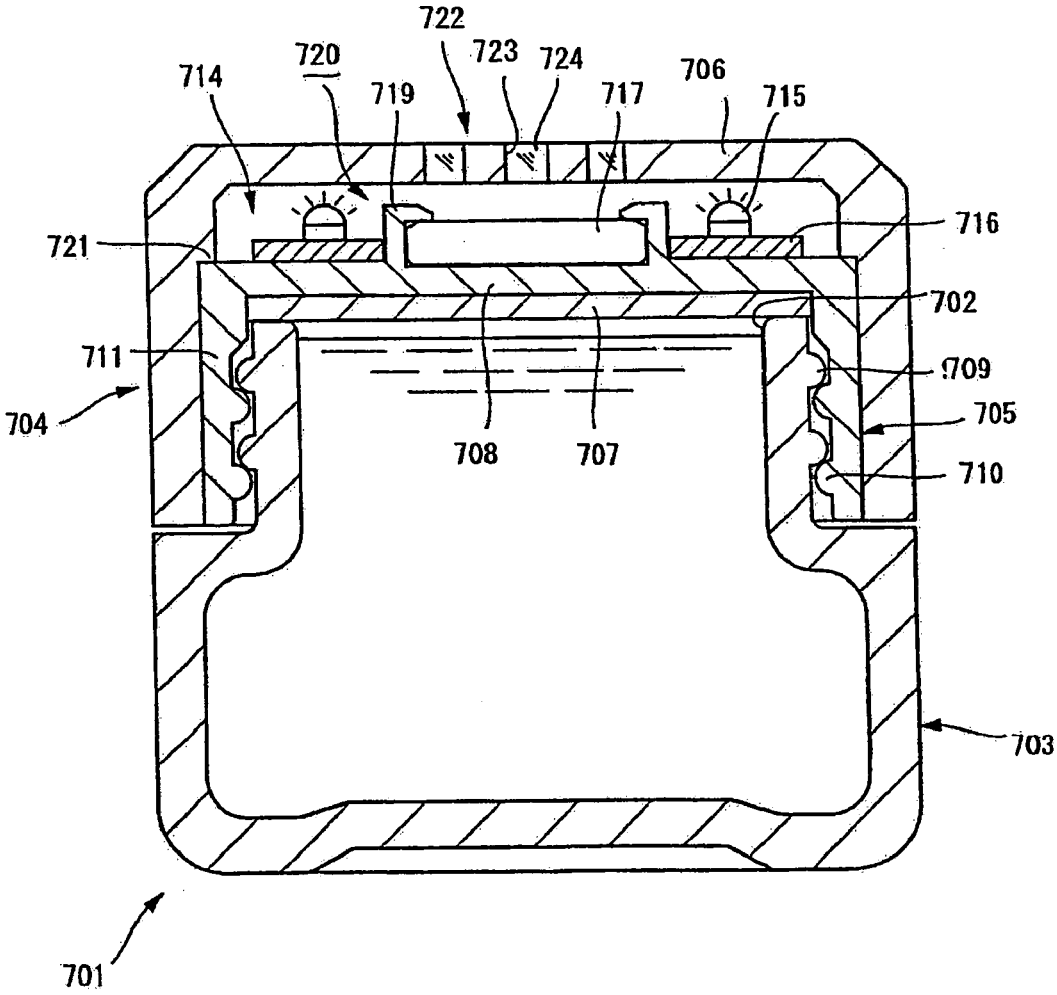
FIG. 29 is a side cross-sectional view of the storage case illustrated in FIG. 28.

FIGS. 28 and 29 illustrate Embodiment 10 of a storage case according to the present invention. In regards to a lid body 704 of this embodiment, an attachable and detachable piece 705 does not comprise an annular peripheral wall portion, and is formed from only a lid portion 708 and an annular skirt portion 711, and a cover 706 is formed cylindrically with a stepped portion 721 to engage the lid portion 708 at an appropriate position at its inner periphery to form a space 720 instead of a recess, and is provided to entirely cover the detachable piece 705. Further in this embodiment, the cover 706 is formed almost entirely of a translucent material, and is partially formed with a light transmitting portion 722 to transmit light of the RGB light source 715 towards a front side of the cover 706 from the space 720.

In the illustrated example, the cover 706 is formed with a plurality of slits 723 which pass through from the front to the back, and in the slits 723 are formed translucent members 724 formed of a translucent material such as plastic, glass, and crystal, with no color or with color, and is transparent or semi-transparent, and thus to form a light transmitting portion 722. When the cover 706 is formed by plastic, by using insert molding, the translucent member 724 can be easily provided in the cover 706. The translucent members 724 in the slits 723 transmit the light of the RGB light source 715 externally from the lid body 704, so as to light up the slits 723. In the second embodiment, it is needless to say that similar effects as the first embodiment can be obtained.

Further, when the light transmitting portion 722 is partially formed as described above, various styles of the light transmitting portion 722 with an arbitrary shape according to letters, marks, and other desired designs can be formed in the lid body 704, and a superior decoration effect can be obtained.

Embodiment 11

Figure 30:
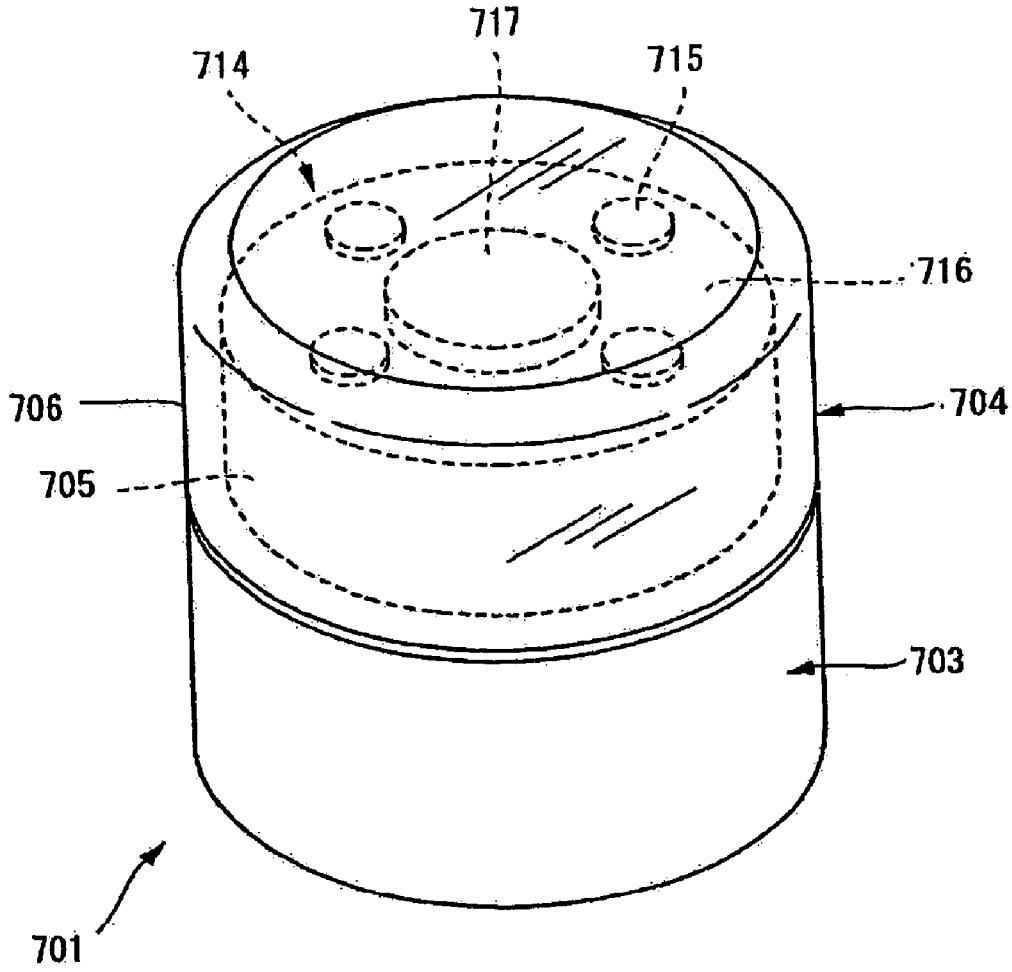
FIG. 30 is a perspective view illustrating an eleventh embodiment of the storage case according to the present invention.
Figure 31:
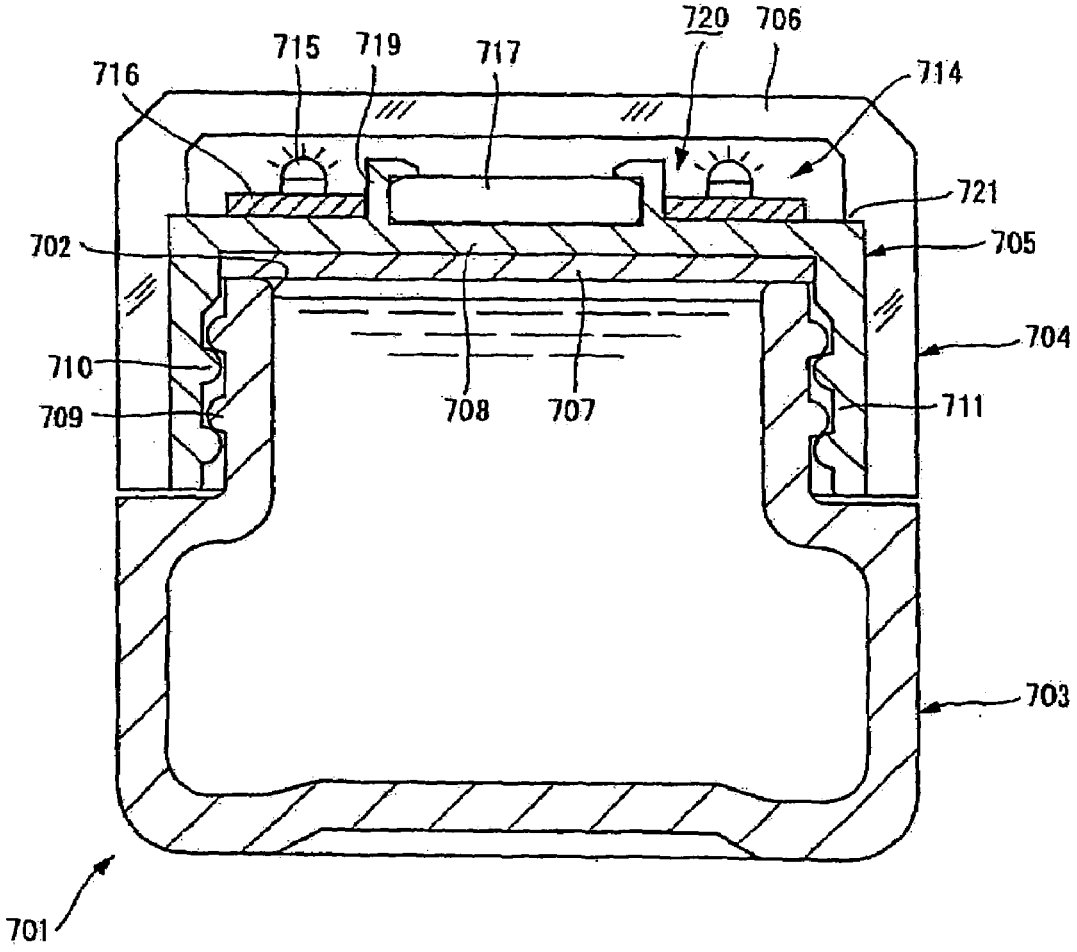
FIG. 31 is a side cross-sectional view of the storage case illustrated in FIG. 30.

In FIGS. 30 and 31, there is illustrated Embodiment 11 of a storage case according to the present invention. In a lid body 704 in this embodiment, the cover 706 in Embodiment 10 is formed entirely of a translucent material. In this embodiment, light of the RGB light source 715 can light up the entire lid body 704, that is, the entire cover 706 covering the entire attachable and detachable piece 705. With this embodiment, it is needless to say that similar effects as the above embodiment can be obtained.

When partially forming the light transmitting portion, the rest of the portion is to be constructed to prevent light of the light source device 714, and for example, if a lightproof mask such as a nontransparent sheet member or a resin molded component partially formed with a stamped out portion is provided by insert molding or the like in the lid body 704, a partial light transmitting portion can be formed by a stamped out portion in the lightproof mask. The lightproof mask can be formed by partially coating the lid body 704 with nontransparent coating. It is needless to say that the lightproof mask can be made by a method, such as by attachment of a stamped out metallic plate according to a design or by sputtering.

Embodiment 12

Figure 32:
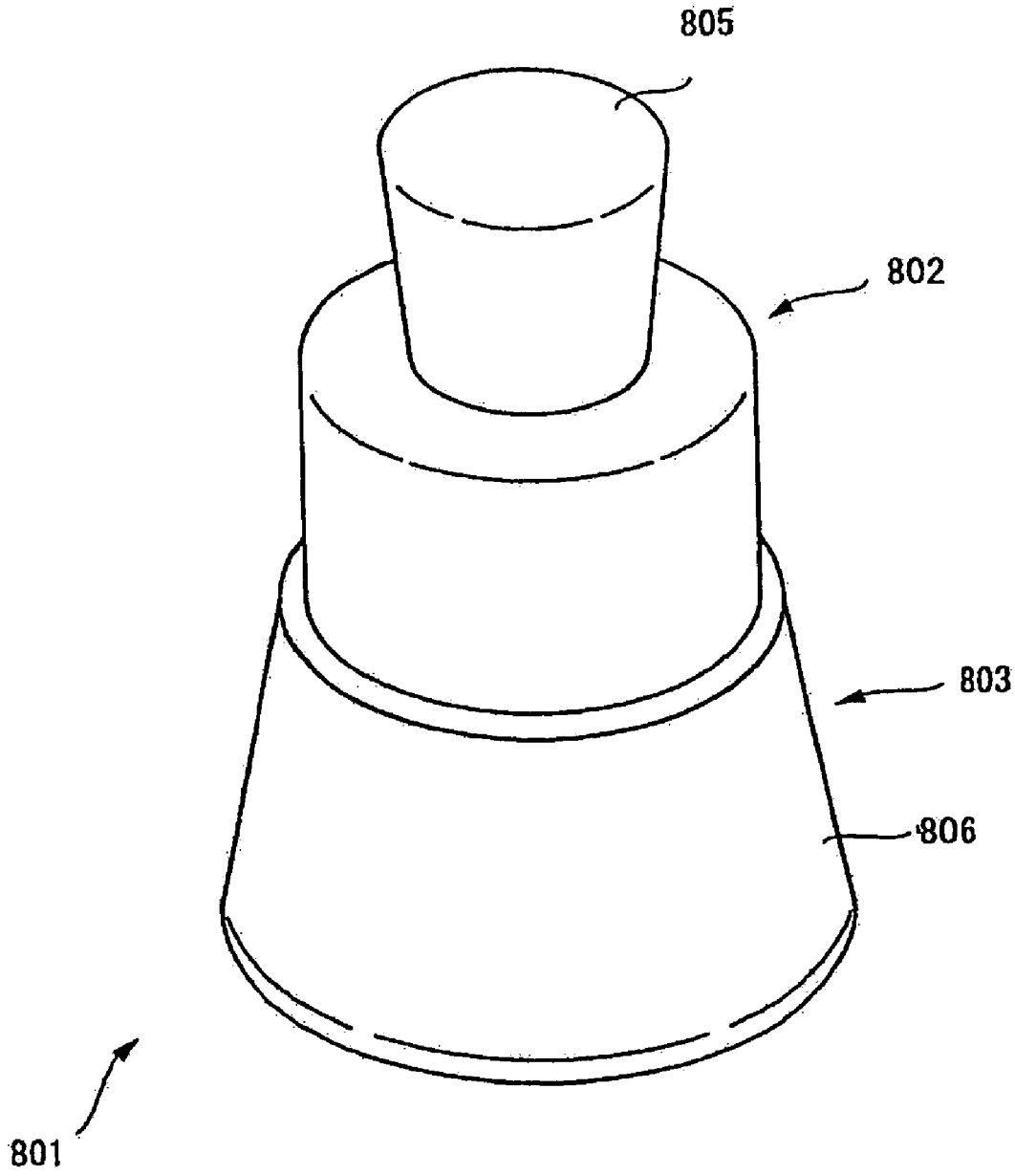
FIG. 32 is a perspective view illustrating a twelfth embodiment of the storage case according to the present invention.
Figure 33:
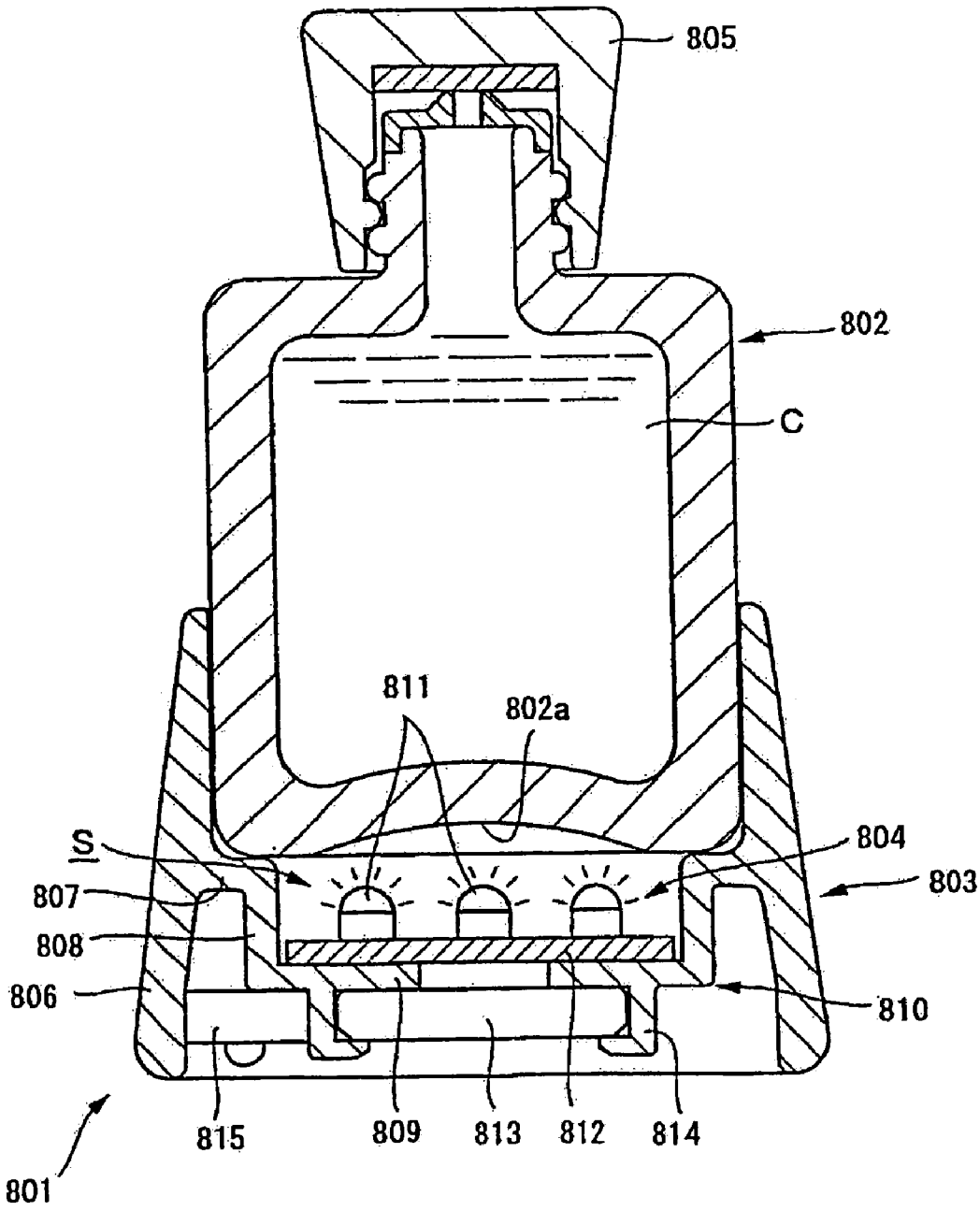
FIG. 33 is a side cross-sectional view of the storage case illustrated in FIG. 32.

As illustrated in FIGS. 32 and 33, a storage case 801 according to Embodiment 12 is mainly constructed of a cylindrical case body 802 made of glass or plastic to store liquid, powder, or cream as content C, an exterior body 803 attached attachably and detachably to a lower portion of the case body 802, and a light source device 804 provided on the exterior body 803. The case body 802 is opened and closed by a screw type cap 805, and by taking off the cap 805 the content C can be removed.

The exterior body 803 becomes a base when it is placed on a ground surface, and is formed of a hollow conical shaped base 806 to be a cover surrounding a lower portion of the case body 802, an annular supporting portion 807 provided at substantially a center portion vertically of the base 806 to protrude inwardly is to mount a bottom portion 802*a* of the case body 802, a peripheral wall portion 808 which droops from an inner outer edge of the supporting portion 807, and an annular flange portion 809 to protrude inwardly from a lower end of the peripheral wall portion 808, and is integrally formed with a storage portion 810 which forms a compartment with an appropriate space S in between the bottom portion 802*a* of the case body 802. Further, the case body 802 is inserted within the base 806 so that its bottom portion 802*a* abuts the supporting portion 807 and it is attached to the exterior body 803, and thus the storage case 801 is constructed.

In this embodiment, a light source device 804 is provided assembled to the storage portion 810 of the exterior body 803. The light source device 804 is constructed of an RGB light source 811 arranged in between the bottom portion 802*a* of the case body 802 and the storage portion 810, an electronic substrate 812 mounted with electronic components constructing the controller to control the light emission amount of each color of the RGB light sources 811, and a battery 813 such as a button-type battery to supply electric power to the electronic substrate 812 and through this to the RGB light source 811. The RGB light source 811 is directly mounted on the electronic substrate 812. In the illustrated example, the battery 813 is retained attachably and detachably in respect to the storage portion 810 by an engaging claw 814 which protrudes as a hook shape from a lower surface of the annular flange portion 809. Further, in the base 806 of the exterior body 803, there is arranged a switch 815 positioned in a space between the engaging claw 814 and the base 806, to switch the light source device 804 on and off.

As the RGB light source 811, there can be applied various light sources that are conventionally known, for example, an LED or an organic electroluminescent (EL) element. As the electronic components constructing the controller, there is included a control element such as an IC chip written in with a programming to control light emission of the RGB light source 811, and as electric power is supplied from the battery 813 by a switch 815, the RGB light source 811 is made to emit light according to the programming.

To cause the RGB light source 811 to emit light, for example, the entire light emission amount can be increased and decreased, to make the RGB light source blink slowly, and while it is blinking, the light emission rate in red, green and blue can be subsequently changed to make it emit light in various colors, or the RGB light source can be made to blink in short time intervals to change color each time to emit light and any kind of programming can be stored in the control element. The light source is not limited to the RGB light source 811, and it is needless to say that it can be a monochromatic light source.

In particular, the exterior body 803 is formed with a light transmitting portion to transmit light of the RGB light source 811. In this embodiment, the entire exterior body 803 is formed of a translucent material such as plastic, glass, or crystal with no color or with color, and is transparent or non-transparent, and the entire exterior body 803 is formed of a light transmitting portion. Further, the exterior body 803 irradiates the light of the RGB light source 811 outwardly from inside the space S, and it is lit up entirely by the light. Further, in this embodiment, the case body 802 is formed entirely by a translucent material similarly to the exterior body 803 as the light transmitting portion, and the light of the RGB light source 811 is transmitted through the case body 802 to light up the case body 802 itself, and also content C if the content C is translucent.

Next, the operation of the storage case 801 in this embodiment comprising the above constructions is described. When the switch 815 is turned on, electric power is supplied from the battery 813 to the RGB light source 811 or the electronic substrate 812, the RGB light source 811 emits light in various colors and brightness while blinking, according to a programming written in the control element. The light of the RGB light source 811 is irradiated externally from the entire exterior body 803 as the light transmitting portion, and lights up the entire front side of the exterior body 803 such as the base 806 in various styles. Further, the light of the RGB light source 811 which transmits through the case body 802, lights up the case body 802 and the content C in various styles. When the switch 815 is turned off, the RGB light source 811 is turned off.

In this way in regards to the storage case 801 according to this embodiment as described above, the light of the light source device 804 provided in the exterior body 803 is transmitted outwardly from inside the exterior body 803 formed entirely of a translucent material, and an entire front side of the exterior body 803 is to be lit up. In this way, the front side of the exterior body 803 can be decorated in various ways using light, and the storage case 801 can be decorated with an aesthetically pleasing or original and novel effect to give a characteristic and unique atmosphere.

Further, the case body 802 is formed entirely of a translucent material, and thus the light transmitting portion is formed, and the light of the light source device 804 can be transmitted through the case body 802 itself to light it, and the content C can also be lit up. In this way, not only the exterior body 803 but also the case body 802 can be decorated diversely using light, and the storage case 801 can obtain an effect using light.

Further, the light source device 804 is constructed of the RGB light source 811, the electronic substrate 812 mounted with the controller to control light emission of the RGB light source 811, and the battery 813 to supply electric power to the electronic substrate 812 and the RGB light sources 811, and the light emission of the RGB light sources 811 is to be controlled by the controller so that various effects by light which appeal to vision can be obtained, and the storage case 801 can be decorated with an aesthetically pleasing or original and novel effect to give a characteristic and unique atmosphere.

In the above embodiment, the case body 802 is formed to have a light transmitting portion and is formed entirely of translucent material, and instead it can of course be formed of a translucent material.

Embodiment 13

Figure 34:
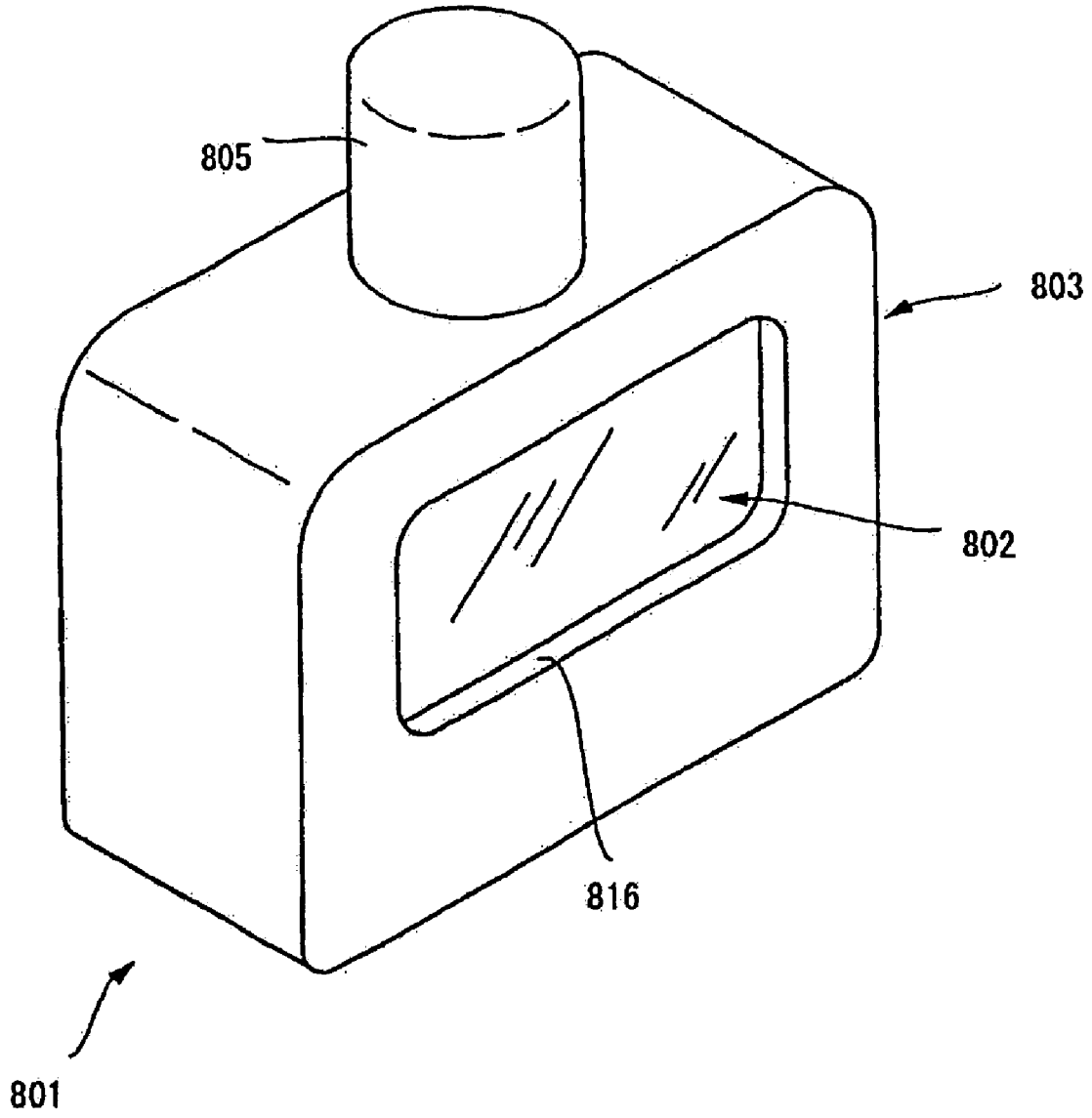
FIG. 34 is a perspective view illustrating a thirteenth embodiment of the storage case according to the present invention.
Figure 35:
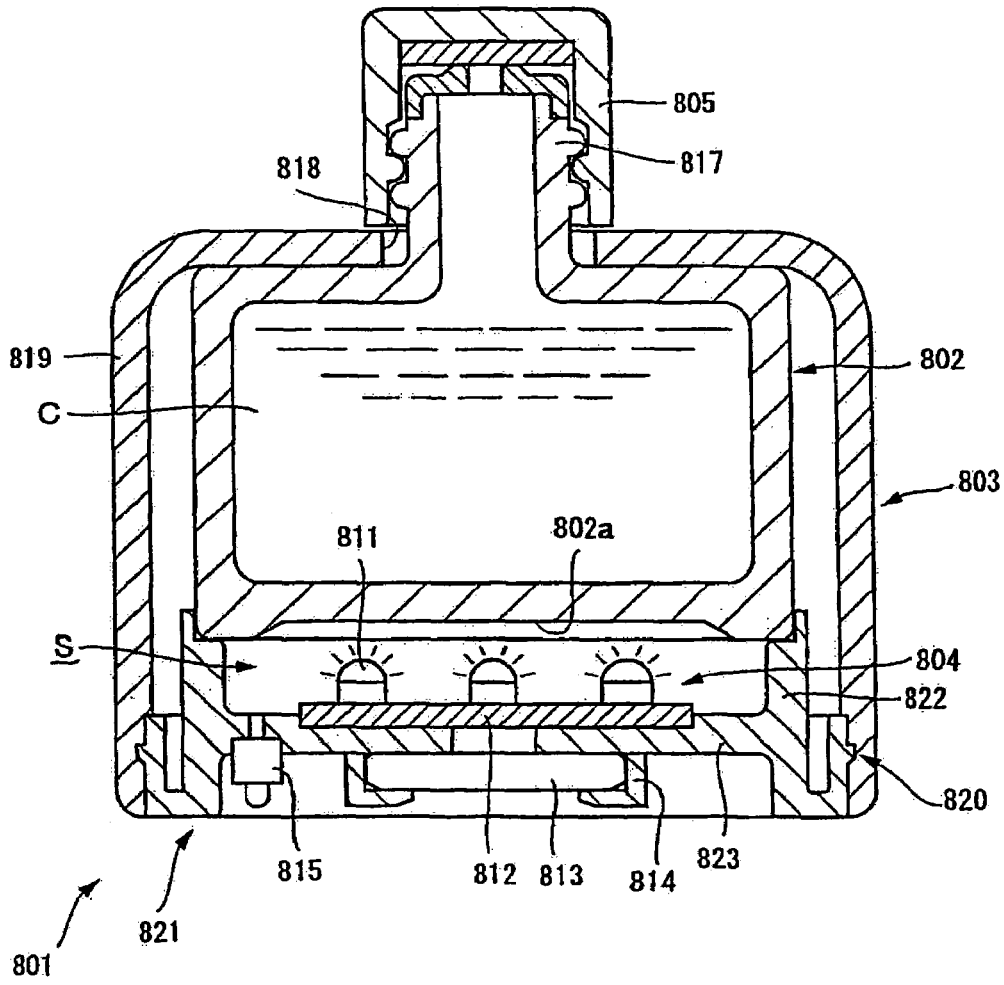
FIG. 35 is a side cross-sectional view of the storage case illustrated in FIG. 34.

In FIGS. 34 and 35 there is illustrated Embodiment 13. In this embodiment, a case body 802 is entirely covered by an exterior body 803 having a window portion 816. In the illustrated example, the case body 802 is formed substantially as a rectangular parallelepiped shape, and surrounding the above, an exterior body 803 is also formed substantially as a rectangular parallelepiped shape. Specifically, the exterior body 803 is formed on a top surface with an opening 818 where a faucet neck portion 817 of the case body 802 passes through, and a bottom surface is open, and further is constructed of two parts of a cover 819 formed with the window portion 816 at a side surface to expose the case body 802, and a sealing member 821 attached attachably and detachably by an engaging and detaching mechanism 820 provided in between the cover body 819 and the sealing member to seal the bottom surface of the cover body 819.

The sealing member 821 is mainly formed molded integrally with an annular peripheral wall portion 822 which engages and supports the bottom portion 802*a* of the case body 802, and an annular flange portion 823 which protrudes inwardly from substantially a center portion vertically of the annular peripheral wall portion 822, and which forms a space S in between the bottom portion 802*a* of the case body 802 and itself. The light source device 804 is assembled on the annular flange portion 823 to be provided on the exterior body 803. The RGB light source 811 of the light source device 804 is arranged in the space S in between the bottom portion 802*a* of the case body 802 and the annular flange portion 823. Further the switch 815 is attached on the bottom surface of the annular flange portion 823.

Further in Embodiment 13, the entire exterior body 803 and the case body 802 are formed by a translucent material such as plastic, glass, or crystal, with no color or with color, and is transparent or semi-transparent. Embodiment 13 can obtain similar effects as Embodiment 12.

On the other hand, in any of the above embodiments, the case body 802 is formed of a translucent material, and the exterior body 803 can be formed of a translucent material. In Embodiment 1, an external appearance of an upper portion of the case body 802 exposed from the exterior body 803 lit up by light of the RGB light source 811 can be obtained. Further, in Embodiment 2, an external appearance of a portion of the case body 802 exposed from the window portion 816 lit up by light of the RGB light source 811 can be obtained. That is, when the exterior body 803 is formed by a translucent material, an external appearance different to when it is formed by a translucent material can be obtained. In such a modified example, a similar effect to the above embodiments can be obtained.

Further, in either of above Embodiment 12 and Embodiment 13, there is described a case where the exterior body 803 or the case body 802 is formed entirely by a translucent material, and is lit up entirely, but of course the light transmitting portion can be formed partially in the exterior body and the like.

When the light transmitting portion is formed partially, the rest of the portion is to be constructed to prevent light of the light source device 804, and for example, if a lightproof mask such as a nontransparent sheet member or a resin molded component formed partially with a stamped out portion is insert molded in the exterior body 803 or the case body 802, or is attached, the stamped out portion of the lightproof mask can form a partial light transmitting portion similar to the above window portion 816. The lightproof mask can be formed by partially coating nontransparent coating on the exterior body 803 and the like. The lightproof mask can of course be made by a method, such as attaching a stamped metal plate according to a design, or by sputtering.

On the other hand, the exterior body 803 or the case body 802 can be formed entirely by a translucent plastic material, and the light transmitting portion can be partially formed by assembling as a separate component a translucent piece of plastic, glass, or crystal, or the like with no color or with color, and is transparent or semi-transparent. In this case, by utilizing insert molding, the translucent piece can be easily provided in the plastic exterior body 803.

In this way, by partially forming the light transmitting portion, the light transmitting portion of various styles with letter, marks, and an arbitrary shape according to desired designs, can be formed in the exterior body 803 or the like, and a superior decoration effect can be obtained.

While the preferred embodiments of the present invention have been described above, the above embodiments are used to fully and easily understand the present invention, and do not in any way limit the present invention. The present invention can be modified and changed without departing from the spirit and scope of the invention, and can include its equivalents.

What is claimed is:

1. A storage case comprising:

an exterior member forming a contour of the storage case, wherein said exterior member includes a case body and a lid body to open and close the case body;

a light source device provided inside the exterior member, a light transmitting portion to transmit light of said light source device, and a mirror plate concealing the light source device, wherein the light source device has an RGB light source and a controller to control the RGB light source and light emission amount of each color of the RGB light source;

a hinge which rotatably connects the lid body to the case body, a battery provided to the case body for supplying electric power to the light source device, and a plurality of contact points provided to the hinge which are enabled to contact and part to form electrical conductivity between said battery and said light source device according to a rotation amount of said lid body.

2. A storage case as claimed in claim 1, wherein said lid body is formed as transparent or semi-transparent to transmit light.

3. A storage case as claimed in claim 1, wherein said lid body is provided with a reflector member to reflect light of said RGB light source.

4. A storage case as claimed in claim 1, wherein said lid body is provided with a transparent or a semi-transparent cover to transmit light covering said light source device.

5. A storage case as claimed in claim 1, wherein a light transmitting portion is formed on the mirror plate.

* * * * *